US007425001B2

(12) United States Patent
Sano et al.

(10) Patent No.: US 7,425,001 B2
(45) Date of Patent: Sep. 16, 2008

(54) SHEET HANDLING APPARATUS AND IMAGE READING APPARATUS

(75) Inventors: Kazuhide Sano, Yamanashi-ken (JP); Syunichi Hirose, Minami-alps (JP)

(73) Assignee: Nisca Corporation, Minamikoma-Gun, Yamanashi-Ken (JP)

( * ) Notice: Subject to any disclaimer, the term of this patent is extended or adjusted under 35 U.S.C. 154(b) by 438 days.

(21) Appl. No.: 10/892,364

(22) Filed: Jul. 16, 2004

(65) Prior Publication Data

US 2005/0012259 A1 Jan. 20, 2005

(30) Foreign Application Priority Data

Jul. 17, 2003 (JP) ..... 2003-275916
Jul. 17, 2003 (JP) ..... 2003-275917

(51) Int. Cl.
*B65H 9/04* (2006.01)

(52) U.S. Cl. ..... 271/242; 271/10.01; 702/103; 702/104

(58) Field of Classification Search ..... 209/590, 209/404; 271/10.01, 242; 702/103, 104
See application file for complete search history.

(56) References Cited

U.S. PATENT DOCUMENTS 3,666,094 A * 5/1972 Martin ..... 209/590
5,963,882 A * 10/1999 Viertl et al. ..... 702/39
5,967,505 A * 10/1999 Lin et al. ..... 271/4.01
6,092,803 A * 7/2000 Munenaka ..... 271/242
6,182,510 B1 * 2/2001 Stanke et al. ..... 73/597
2002/0053767 A1 * 5/2002 So ..... 271/10.01
2002/0105132 A1 * 8/2002 Brugger et al. ..... 271/10.01
2003/0047862 A1 * 3/2003 Komatsu ..... 271/10.01

FOREIGN PATENT DOCUMENTS

JP 06-072591 3/1994
JP 06072591 A * 3/1994
JP 6-49567 12/1994
JP 2001-354339 12/2001
JP 2001354339 A * 12/2001

* cited by examiner

*Primary Examiner*—Patrick Mackey
*Assistant Examiner*—Kalyanavenkateshware Kumar
(74) *Attorney, Agent, or Firm*—Manabu Kanesaka

(57) ABSTRACT

A sheet handling apparatus includes a sheet stacker for stacking sheets; a separating device for separating and feeding the sheets stacked on the sheet stacker; and a register roller disposed adjacent to the separating device for correcting a skew of the sheet. An ultrasonic wave sensor composed of a wave sending sensor and a wave receiving sensor is arranged between the separating device and the register roller obliquely relative to a surface of the sheet. A judging device is electrically connected to the ultrasonic wave sensor for detecting a double feed of the sheets based upon an output signal from the wave receiving sensor at a predetermined time after the register roller starts rotating. A control device electrically connected to the judging device and the register roller controls the register roller to stop and rotate.

7 Claims, 18 Drawing Sheets

SHEET HANDLING APPARATUS AND IMAGE READING APPARATUS

BACKGROUND OF THE INVENTION AND RELATED ART STATEMENT

The present invention relates to a sheet handling apparatus equipped with sheet separating means for separating sheets stacked on a sheet stacker into a single sheet and feeding the single sheet toward a downstream side. More particularly, the present invention relates to a sheet handling apparatus and an image reading apparatus that detect whether two or more sheets are overlapped and transported (double feed).

An image reading apparatus is mounted on a copier or facsimile machine for separating sheets (such as cut sheets or plastic sheets) stacked on a sheet stacker. In a case of a copier, an image reading apparatus separates sheets from a cassette into a single sheet and feeds the single sheet to a printing unit, so that characters or images are printed on the sheet.

In such a sheet handling apparatus for reading images on originals or printing, it is technically important to securely separate sheets stacked on a sheet stacker such as an original tray or a paper cassette and feed a single sheet one at a time. Accordingly, an automated document feeder (hereinafter referred to as 'ADF') is provided with a sheet separating mechanism for separating sheets stacked on a sheet stacker (feeder tray) into a single sheet, so that the automated document feeder feeds the single sheet one at a time. Japanese Patent Publication (Kokai) No. 2001-354339 has disclosed an example of such a sheet separating mechanism.

In the sheet separating mechanism disclosed in Japanese Patent Publication (Kokai) No. 2001-354339, a draw roller capable of rising and lowering touches the uppermost sheet stacked on the sheet stacker to draw the original (sheet). A feed roller is provided for feeding only the uppermost original (sheet), and a separating pad is provided for preventing the second sheet from being fed.

There may be a case in which sheets (particularly originals) stacked on a sheet stacker have a bent edge or are bound with a paper clip or staples. In such a case, even if the sheet separating mechanism described above is provided, it is difficult to securely separate sheets into a single sheet for feeding. For this reason, it is necessary to determine whether a single sheet is fed normally, or two sheets are overlapped and fed, described herein as 'double feed'. Conventionally, an ultrasonic wave sensor has been known as a device in the art for detecting whether sheets are double fed.

In Japanese Utility Model Publication (Kokoku) No. 06-49567, an ultrasonic wave axis is formed of an ultrasonic wave sending device arranged above a transfer surface of a subject to be detected and an ultrasonic wave receiving device arranged below the transfer surface. The ultrasonic wave axis is arranged with an angle relative to the transfer surface, so that the ultrasonic wave receiving device detects a stable amount of an ultrasonic wave.

In Japanese Patent Publication (Kokai) No. 06-72591, an ultrasonic wave detector is arranged in a marking device disposed in a handover portion where a sheet is fed from a paper tray to a finishing apparatus. The ultrasonic wave detector is composed of a wave sending sensor and a wave receiving sensor arranged with the sheet in between, so that an ultrasonic wave is applied to the sheet with an angle to detect the double feed.

However, when a thin sheet is transported, the sheet tends to flap vertically. Accordingly, it is technically important to dispose an ultrasonic wave sensor at a proper position to receive an ultrasonic wave at a proper timing to accurately detect the double feed. Particularly, when an ultrasonic wave sensor is used for accurately detecting the double feed, a space between sheets becomes an important factor. If a gap is intentionally generated between sheets and a sensor detects the sheets after the sheets are extended in parallel to a traveling surface, it is possible to accurately detect the double feed of the sheets.

In the conventional ADF, an optical sensor for detecting a position of a sheet in a feeding path and an ultrasonic wave sensor for detecting the double feed of sheets are arranged separately at different locations. Based on output signals from the sensors, a timing of drawing a sheet is controlled, and a length of the sheet and the double feed are detected. In such a sheet handling apparatus having a function of detecting the double feed, it is necessary to separately dispose in a limited space an ultrasonic wave sensor for detecting the double feed and a sensor (corresponding to 'register sensor' disclosed in Japanese Patent Publication (Kokai) No. 2001-354339) for detecting a leading edge and a trailing edge of a sheet in a sheet path.

In view of the problems described above, the present invention has been made, and an object of the invention is to provide a sheet handling apparatus and an image reading apparatus capable of accurately detecting whether a sheet stacked on a sheet stacker is correctly fed one at a time without the double feed.

Another object of the invention is to provide a sheet handling apparatus and an image reading apparatus having one detection device capable of detecting both the double feed of sheets stacked on a sheet stacker to determine that the sheet is correctly fed one at a time, and a leading edge and/or a trailing edge of the sheet.

Further objects and advantages of the invention will be apparent from the following description of the invention.

SUMMARY OF THE INVENTION

To obtain the objects described above, according to a first aspect of the present invention, a sheet handling apparatus includes a sheet stacker; separating means for separating sheets stacked on the sheet stacker and feeding the sheet; a register roller for correcting a skew of the sheet fed from the separating means; an ultrasonic wave sensor arranged between the separating means and the register roller with an angle relative to a surface of the sheet, and formed of a wave sending sensor and a wave receiving sensor; judging means for detecting double feed of the sheets based upon an output signal from the wave receiving sensor; and control means for controlling stopping and driving of the register roller. The judging means detects the double feed of the sheets based upon the output signal from the wave receiving sensor after a predetermined time after the register roller starts to rotate.

In the sheet handling apparatus, the ultrasonic wave sensor is formed of the wave sending sensor and the wave receiving sensor, and is arranged between the separating means and the register roller with an angle relative to the sheet travel surface. When the register roller corrects a skew, a gap is generated between the sheets. When the register roller starts to rotate from a stopped state, it is determined whether the sheets are double fed based upon the output signal from the wave receiving sensor after a predetermined time. Accordingly, it is possible to accurately detect whether the sheets are double fed.

The wave receiving sensor is arranged between the separating means and the register roller above the sheet travel surface, and the wave sending sensor is arranged below the sheet travel surface. Accordingly, it is possible to prevent detection accuracy from being deteriorated due to dust or other foreign matter falling from the sheets onto a surface of the wave receiving sensor with time. The judging means continuously determines whether the sheets from the separating means are double fed while a trailing edge of the sheet passes through the register roller, thereby making it possible to accurately detect the double feed. When the judging means determines that the sheets from the separating means are double fed, the system stops feeding a subsequent sheet from the sheet stacker.

According to a second aspect of the present invention, an image reading apparatus includes a sheet stacker; separating means for separating sheets stacked on the sheet stacker and feeding the sheet; a register roller for correcting a skew of the sheet fed from the separating means; transport means for transporting the sheet from the register roller to a reading position; optical reading means for reading the sheet transported to the reading position; an ultrasonic wave sensor arranged between the separating means and the register roller with an angle relative to a surface of the sheet, and formed of a wave sending sensor and a wave receiving sensor; judging means for detecting double feed of the sheets based upon an output signal from the wave receiving sensor; and control means for controlling stopping and driving of the register roller. The judging means detects the double feed of the sheets based upon the output signal from the wave receiving sensor after a predetermined time after the register roller starts to rotate.

When the judging means determines that the sheets from the separating means are double fed, the optical reading means stops reading images on the sheets, or a result of the determination is displayed after all the sheets stacked on the sheet stacker are read. In the second aspect of the invention, the sheet handling apparatus accurately detects the double feed of the sheets, even when the sheets are thin sheets and tend to flap or vibrate in up and down directions during transportation.

In the sheet handling apparatus, the wave receiving sensor is arranged above the sheet travel surface. Accordingly, it is possible to prevent detection accuracy from being deteriorated due to dust or other foreign matter falling from the sheets onto a surface of the wave receiving sensor with time. The wave sending sensor generates large ultrasonic wave vibrations at a surface thereof as compared with the wave receiving sensor. Accordingly, paper dust and dirt easily fall from the surface of the wave sending sensor, which is arranged with an angle relative to a plane perpendicular to the direction of gravity. The judging means continuously determines whether the sheets from the separating means are double fed while a trailing edge of the sheet passes through the register roller, thereby making it possible to accurately detect the double feed.

According to a third aspect of the present invention, a sheet handling apparatus includes a sheet stacker; separating means for separating sheets stacked on the sheet stacker and feeding the sheet; a register roller for correcting a skew of the sheet fed from the separating means; an ultrasonic wave sensor arranged between the separating means and the register roller and formed of a wave sending sensor and a wave receiving sensor; and judging means for detecting a trailing edge and a leading edge of the sheet and for detecting double feed of the sheet based on an output signal from the wave receiving sensor. The judging means detects the leading edge and the trailing edge of the sheet, thereby determining a size of the sheet (length of the sheet in a feeding direction).

In the third aspect of the invention, the judging means executes a first comparison for detecting the leading edge and the trailing edge of the sheet, and a second comparison for determining whether the sheets are double fed. The second comparison is performed at timing under a condition different from those of the first comparison. The leading edge and the trailing edge of the sheet are detected at different timing under a different condition than the detection of the double feed of the sheets. Accordingly, it is possible to detect both the sheet and the double feed with only one sensor as compared with a conventional apparatus using a plurality of sensors. The first timing may be a moment when the leading edge or the trailing edge of the sheet passes a position where the ultrasonic wave sensor is disposed. The second timing may be a moment or a plurality of moments after a predetermined time after the leading edge of the sheet reaches at the register roller. The wave sending sensor and the wave receiving sensor may be arranged to face each other between the separating means and the register roller with an angle relative to the sheet travel surface. Accordingly, the wave receiving sensor receives a steady amount of ultrasonic wave, even if the sheet surface vibrates up and down during the transportation.

In the present invention, the judging means may have the following structures. The judging means may include a comparator circuit for performing first comparison and second comparison and a wave reception amplifier for amplifying an output signal of the wave receiving sensor. The comparator circuit performs the first comparison and the second comparison while a gain of the amplifier is varied.

The judging means may include the comparator circuit for performing the first comparison and the second comparison and the wave reception amplifier for amplifying the output signal of the wave receiving sensor. The comparator circuit performs the first comparison and the second comparison, while a standard value input to the comparator circuit is varied.

The judging means may include a first comparator circuit for performing the first comparison; a second comparator circuit for performing the second comparison; a first wave receiving amplifier for amplifying the output signal of the wave receiving sensor at a predetermined gain; and a second wave receiving amplifier for amplifying the output signal of the wave receiving sensor at a gain different from that of the first amplifier.

The judging means may include a comparator circuit for performing the first comparison and the second comparison; a wave receiving amplifier for amplifying the output signal of the wave receiving sensor; and a wave sending amplifier for adjusting a level of an ultrasonic wave output from the wave sending sensor. The comparator circuit performs the first comparison and the second comparison, while a gain of the wave sending amplifier is varied.

The judging means may include a wave receiving amplifier for amplifying only the output signal of the wave receiving sensor at a predetermined gain, and an A/D converter for converting an analog output from the wave receiving amplifier into a digital signal. The comparator circuit performs the first comparison and the second comparison based on the digital output signal from the A/D converter.

With the judging means having the structure described above, it is possible to detect the leading edge of the sheets and the double feed.

In the sheet handling apparatus, when the judging means determines that the sheets out from the separating means are in the double feed, the subsequent sheets being fed from the sheet stacker are stopped. A warning of the double feed is displayed, so that an operator can check the sheets to locate a fold in an edge and retry feeding the sheets.

According to a fourth aspect of the present invention, an image reading apparatus comprises a sheet stacker; separating means for separating sheets stacked on the sheet stacker and for feeding the sheets; a register roller for correcting a skew in the sheets fed from the separating means; transport means for transporting the sheets from the register roller to a reading position; optical reading means for reading the sheets on the reading position; an ultrasonic wave sensor composed of a wave sending sensor and a wave receiving sensor and arranged obliquely relative to a sheet travel surface between the separating means and the register rollers; and judging means for detecting leading and trailing edges of the sheet and the double feed of the sheets based on an output signal from the wave receiving sensor.

In the sheet handling apparatus described above, one ultrasonic wave sensor detects the double feed of the sheets and the leading edge and trailing edge of the sheets. Accordingly, it is possible to dispose the ultrasonic wave sensor at an optimum position in a feeding path with a limited space, so that the double feed of the sheets and the size of the sheets are accurately detected. Also, the sheet handling apparatus has a simple structure, thereby reducing cost.

DETAILED DESCRIPTION OF PREFERRED EMBODIMENTS

Figure 1:
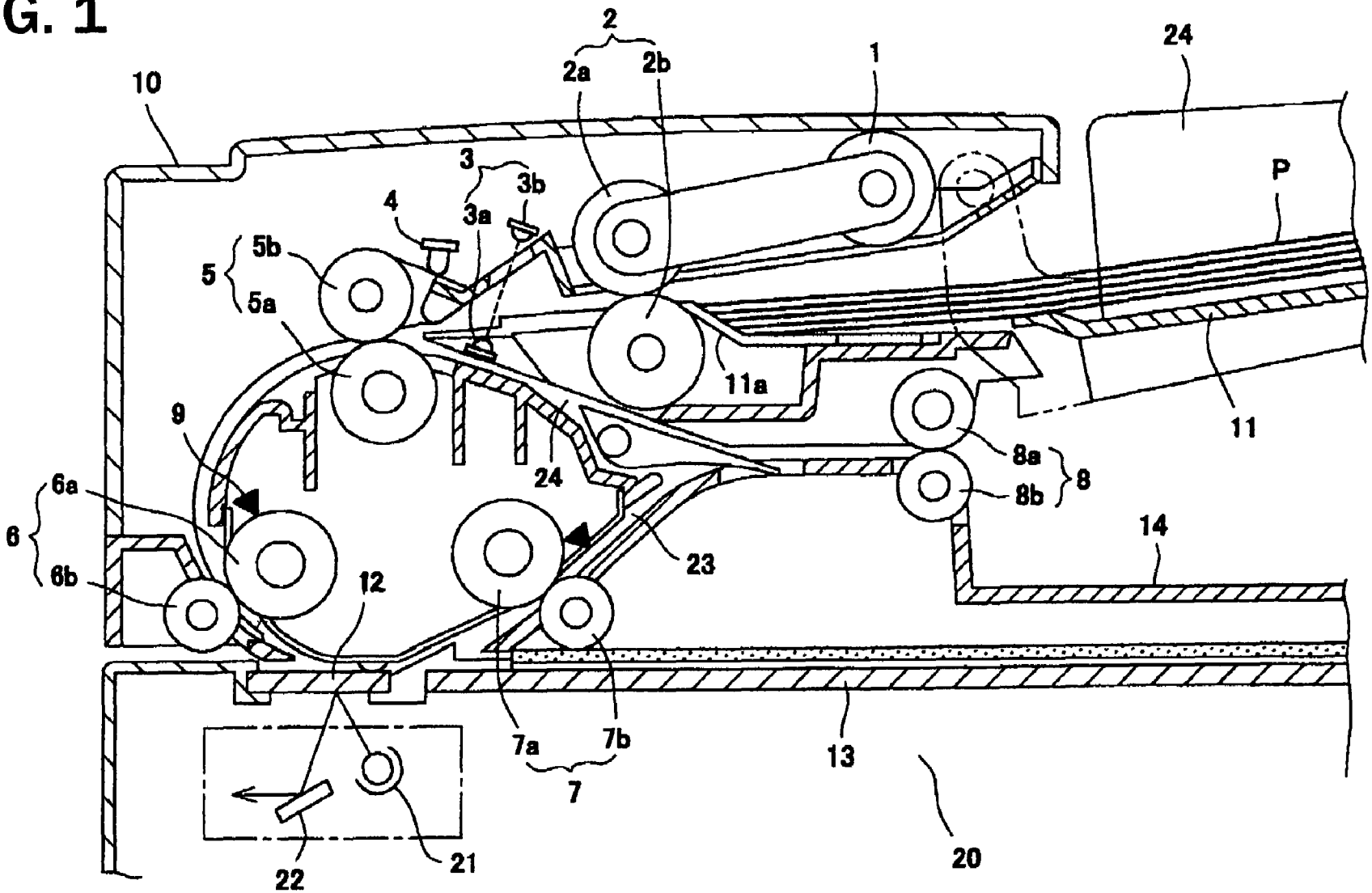
FIG. 1 is a sectional view showing an ADF as a sheet handling apparatus according to the present invention.

Hereunder, embodiments of the invention will be explained with reference to the accompanied drawings. FIG. 1 is a view showing an ADF 10 as a sheet handling apparatus according to an embodiment of the present invention. As shown in FIG. 1, the ADF 10 is mounted on an image reading apparatus 20 for feeding a sheet (original) over a top surface of a platen 12 on a main unit 20. In the image reading apparatus 20, a light source 21 of optical reading means is arranged below the platen 12 for irradiating light on the sheet. The reflected light is guided to a CCD using a mirror 22 or prism, so that the CCD converts an image on the sheet into an electrical signal.

The image reading apparatus 20 is equipped with a second platen 13 with a surface area large enough to place an entire surface of the sheet thereupon. The ADF 10 opens and closes to read the image on the sheet placed on the platen 13. The ADF 10 comprises a sheet stacker 11 for stacking a plurality of sheets; a kick roller 1 for picking up the sheets stacked on the sheet stacker 11 and feeding the sheets toward a downstream side; separating means 2 for separating the sheets fed by the kick roller into a single sheet and feed the sheet to the platen 12; a pair of register rollers 5 for removing any skew in the sheet fed from the separating means 2; an ultrasonic wave sensor 3 arranged between the separating means 2 and the pair of register rollers 5 for detecting double feed of the sheets fed from the separating means 2; a pair of first transport rollers 6 for passing the sheet fed from the pair of register rollers 5 over the top surface of the platen 12 while contacting thereto; a pair of second transport rollers 7 for receiving the sheet passed over the platen 12 and transporting the sheet further toward a downstream side; and a pair of discharge rollers 8 for discharging the sheet transported from the pair of second transport rollers 7 to a discharge stacker 14.

Furthermore, a register sensor 4 is disposed on an upstream side of the pair of register rollers 5 for detecting a leading edge of the sheet fed from the separating means and arriving at the pair of register rollers 5. The ultrasonic wave sensor 3 is composed of a wave sending sensor 3*a* and a wave receiving sensor 3*b* arranged obliquely relative to a sheet travel surface between the separating means 2 and the pair of register rollers 5 with the sheet travel surface in between. The wave sending sensor 3*a* is arranged below the sheet travel surface, and the wave receiving sensor 3*b* is arranged above the sheet travel surface.

The ADF 10 is also provided with a switchback path 24 for switching back the sheet in a discharge path from the platen 12 to the discharge stacker 14, and for feeding the sheet into the pair of register rollers 5 on the platen 12 again.

The sheet stacker 11 is arranged above the discharge stacker 14 and is inclined at a predetermined angle. A side guide 24 aligns the sheets stacked on the sheet stacker 11. The sheets are placed on the sheet stacker 11 so that their leading edges are pushed against and touch a leading edge portion 11*a* of the sheet stacker 11. The kick roller 1 moves vertically to pick up the sheets and lowers to touch the uppermost sheet stacked on the sheet stacker 11 to pick up toward a downstream side (separating means 2). At this time, just one single sheet is not always picked up.

The separating means 2 is composed of a feed roller 2*a* for feeding the sheets kicked out from the kick roller 1 further toward a downstream side, and a separating roller 2*b* for passing only the uppermost sheet to prevent the second and subsequent sheets below the uppermost sheet from being kicked out. The separating roller 2*b* is stopped when feeding the sheets, thereby preventing the second or subsequent sheets below the uppermost sheet from being kicked out. It is also perfectly acceptable to use a no-rotating separating pad instead of the separating roller 2*b*.

Then, the sheet passes through the separating means 2 and is fed to the pair of register rollers 5. The pair of register rollers 5 is stopped when the leading edge of the sheet kicked out from the separating means 2 abuts against the pair of register rollers 5. The pair of register rollers 5 is driven to rotate for a predetermined period of time after the leading edge of the sheet arrives at the pair of register rollers 5, so that a loop is formed in the sheet between the pair of register rollers 5 and the separating means 2 to align the leading edge of the sheet, thereby removing any skew of the sheet.

In the ADF 10, the separating roller 3*b* of the separating means and a drive roller 5*a* of the pair of register rollers 5 are driven by a single feed drive motor (not shown). When the feed drive motor rotates in the forward direction, the separating roller 3*b* is driven to rotate and the pair of register rollers 5 is stopped. Conversely, when the feed drive motor rotates in the reverse direction, the separating roller 3*b* is stopped and the pair of register rollers 5 is driven to rotate.

In the ADF, a loop is formed in the sheet between the repair register rollers 5 and the separating means 2. After the pair of register rollers 5 is driven to rotate from a stopped state, the ultrasonic wave sensor 3 determines whether the sheets are double fed based on an output signal of the wave receiving sensor 3*b* after the loop is removed (described in further detail below). Accordingly, it is possible to accurately detect the double feed of the sheets.

The sheet fed from the pair of register rollers 5 is then fed to the pair of first transport rollers 6. The pair of first transport rollers 6 transports the sheet while the sheet contacts the upper surface of the platen 12, so that the optical reading means arranged below the platen 12 optically reads the sheet.

In a single side reading mode, the sheet having an image on one side is optically read and discharged to the discharge stacker 14 via the discharge past 23 by the pair of second transport rollers 7. In a duplex reading mode, the pair of discharge rollers 8 rotates in reverse to switch back the sheet and the sheet is returned to the pair of register rollers 5 via the switchback path 24. A flapper 29 is arranged at an intersecting position of the discharge path 23 and the switchback path 24, and is constantly urged downwardly by an urging spring (not shown). When the sheet is fed to the pair of discharge rollers 8 along the discharge path 23, the leading edge of the sheet pushes the flapper upwardly to pass through. When the pair of discharge rollers 8 switchbacks the sheet, the flapper is positioned at a lower position to cover the discharge path 23, thereby guiding the original into the switchback path 24.

Figure 2A:
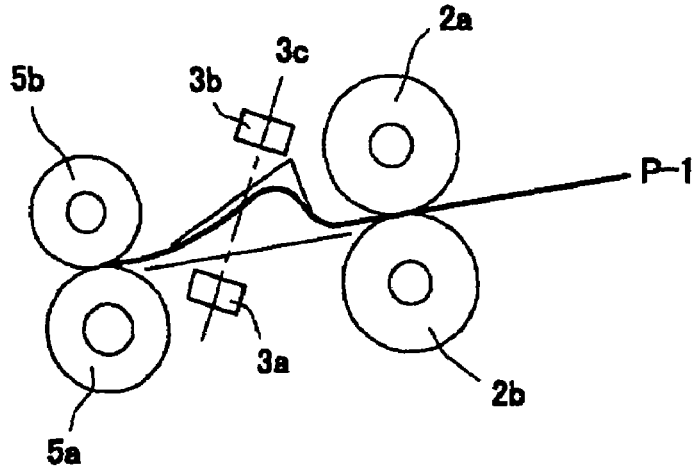
FIGS. 2(*a*), 2(*b*) and 2(*c*) are views showing separating means, register rollers and an ultrasonic wave sensor in the sheet handling apparatus.
Figure 2B:
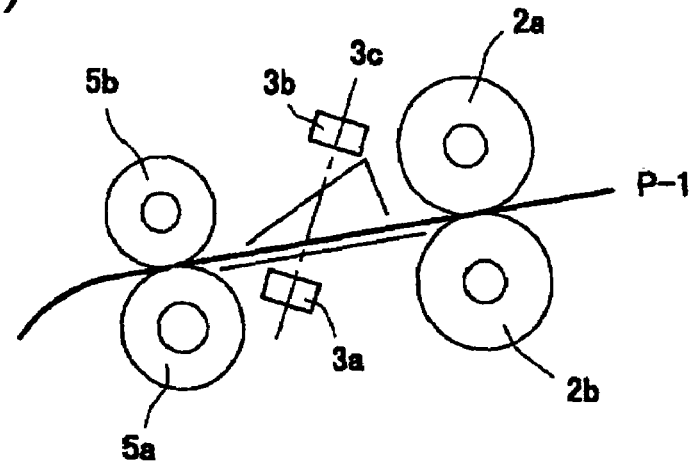
Figure 2C:
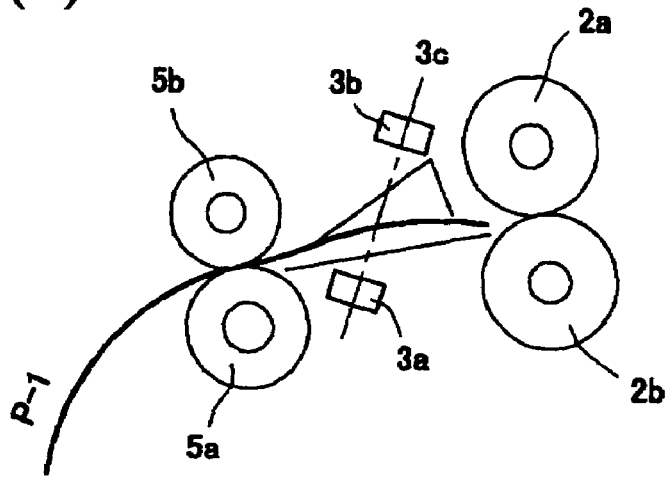

FIGS. 2(*a*) to 2(*c*) are views showing the separating means 2, the pair of register rollers 5, and the ultrasonic wave sensor 3. As described above, the ultrasonic wave sensor 3 is composed of the wave sending sensor 3*a* and the wave receiving sensor 3*b*, and is arranged obliquely relative to the sheet travel surface between the separating means 2 and the pair of register rollers 5 with the surface in between. The wave sending sensor 3*a* is arranged below the sheet travel surface, and the wave receiving sensor 3*b* is arranged above the sheet travel surface.

The ultrasonic wave sensor 3 is arranged obliquely and sandwiches the sheet travel surface to stabilize an amount of an ultrasonic wave received by the wave receiving sensor 3*b*. When the wave sending sensor 3*a* and the wave receiving sensor 3*b* are arranged orthogonally to sandwich the sheet travel surface, an amount of an ultrasonic wave is greatly varied even by a small movement of the sheet, thereby making it difficult to accurately detect the double feed of the sheets. The wave receiving sensor 3*b* is arranged above the sheet travel surface, so that dust or dirt from the sheets does not accumulate on a surface of wave receiving sensor 3*b*, thereby ensuring the accuracy of detection of the ultrasonic waves.

As shown in FIG. 2(*a*), the pair of register rollers 5 is controlled to stop when a leading edge of a sheet P-1 fed from the separating means 2 reaches the rollers. Accordingly, as shown in FIG. 2(*a*), after the leading edge of the sheet P-1 abuts against the pair of register rollers 5, the separating means 2 further pushes the sheet to form a loop in the sheet P. In this case, a shape and a size (diameter) of the loop are not stable, so that the loop is not proper for detecting the double feed of the sheets.

After the leading edge of the sheet P contacts the pair of register rollers 5, the pair of register rollers 5 starts to rotate after a predetermined period of time. When the pair of register rollers 5 starts to rotate, the separating roller 2*a* of the separating means 2 stops, so that the loop is gradually removed and the sheet is straightened out. FIG. 2(*b*) shows a state that the sheet P with a loop is straightened out with regard to the travel surface between the separating means 2 and the pair of register rollers 5. This is the optimum timing for detecting the double feed of the sheet P. At this time, the sheet P is nipped at the leading and trailing edges thereof by the separating means 2 and the pair of register rollers 5, thereby suppressing vertical vibration or movement. If the sheets P are double fed, when the loop is formed therein as shown in FIG. 2(*a*), a gap is generated between the sheets. The gap attenuates the ultrasonic wave, so that the ultrasonic wave sensor 3 is able to accurately detect the double feed of the sheets.

FIG. 2(*c*) shows a state that the sheet P is transported further toward a downstream side by the pair of register rollers 5, and the trailing edge of the sheet P is released from the nip of the separating means 2. In this state, the sheet P flaps and moves up and down around on the nipping point of the pair of register rollers 5, so it is not possible to accurately detect the double feed of the sheets based on the output signal of the wave receiving sensor 3*b*.

Figure 3:
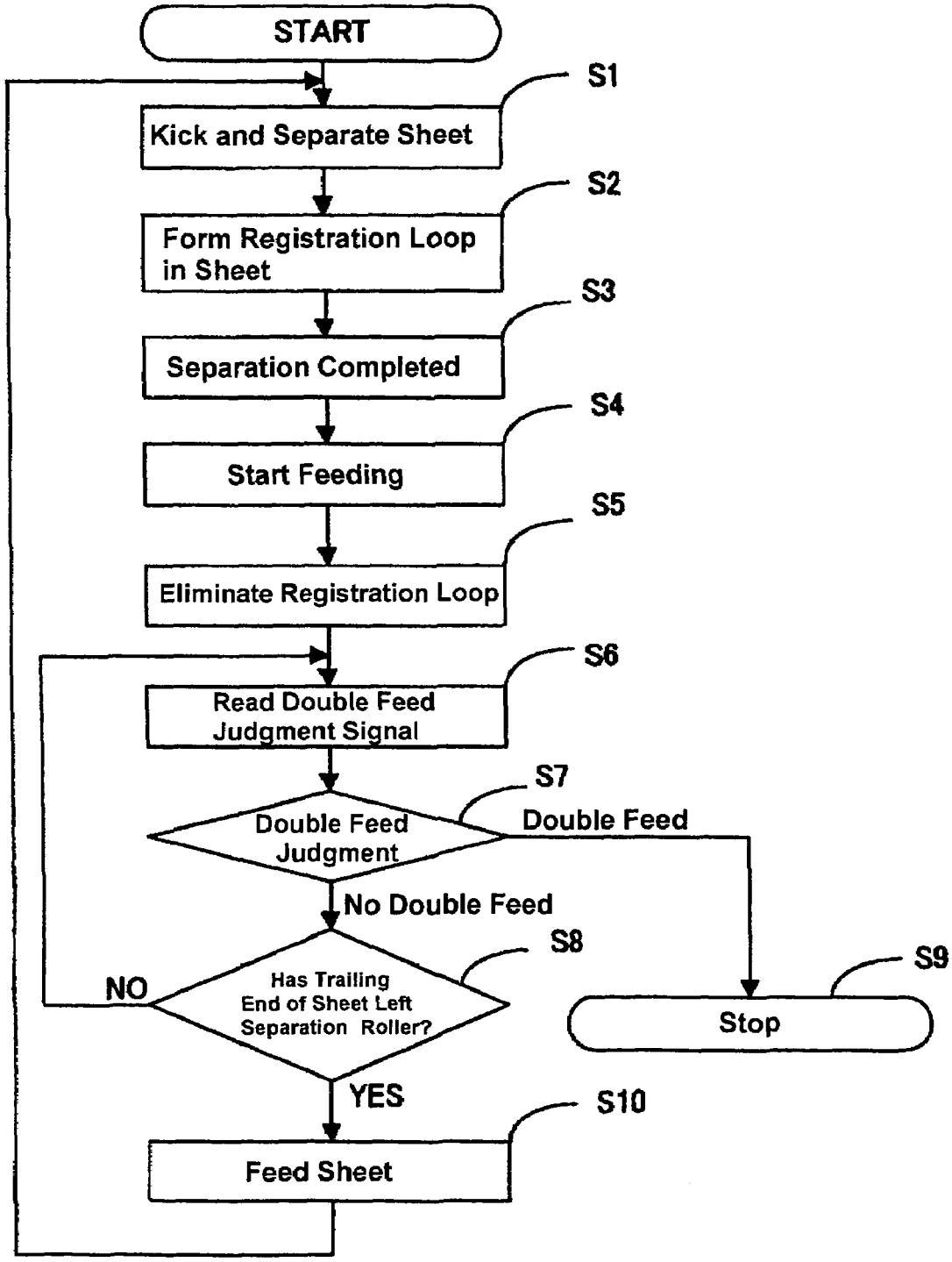
FIG. 3 is a flow chart for explaining timing of reading an output signal of a wave receiving sensor of the ultrasonic wave sensor.

FIG. 3 is a flow chart for explaining timing of reading the output signal of the wave receiving sensor 3*b* of the ultrasonic wave sensor 3. The flow chart shown in FIG. 3 will be explained with reference to FIG. 1. Among the sheets fed from the kick roller 1, only the uppermost single sheet passes through the separating means 2, and the second or subsequent sheets below the uppermost sheet do not pass. The sheet kicked out from the kick roller 1 is fed to the pair of register rollers 5 (S1). The pair of register rollers 5 does not rotate when the leading edge of the sheet from the separating means 2 abuts against the register rollers, so that a loop is formed in the sheet at the pair of register rollers 5 (S2). The separating rollers 2*a* and 2*b* of the separating means 2 are stopped at this time to stop separating the sheets (S3).

Next, the pair of register rollers 5 is driven to rotate for a predetermined period of time to feed the sheet after the leading edge of the sheet arrives at the pair of register rollers 5 (S4). The loop formed while the pair of register rollers 5 stops is removed from the sheet (S5) to correct a skew in the sheet. At this point, the output signal of the wave receiving sensor 3*b* of the ultrasonic wave sensor 3 is read (S6). Accordingly, it is determined whether the sheets are double fed based on the output signal of the wave receiving sensor 3*b* when the loop is removed from the sheet at the pair of register rollers 5 (S7). When the double feed is detected, the ADF stops and warning is displayed (S9). It is also acceptable to continue reading the sheets even if the double feed is detected, and then to display a warning to the operator after reading all the sheets.

When the double feed is not detected, the system continues the judging (S6 and S7) whether the sheets are double fed based on the output signal of the wave receiving sensor 3*b* until the trailing edge of the sheet passes through the separating means 2 (S8), so that the double feed of the sheets is further accurately detected. When the trailing edge of the sheet passes through the separating means 2, the sheet is fed toward a downstream side (S10), and the next sheet is kicked out and separated.

Figure 4:
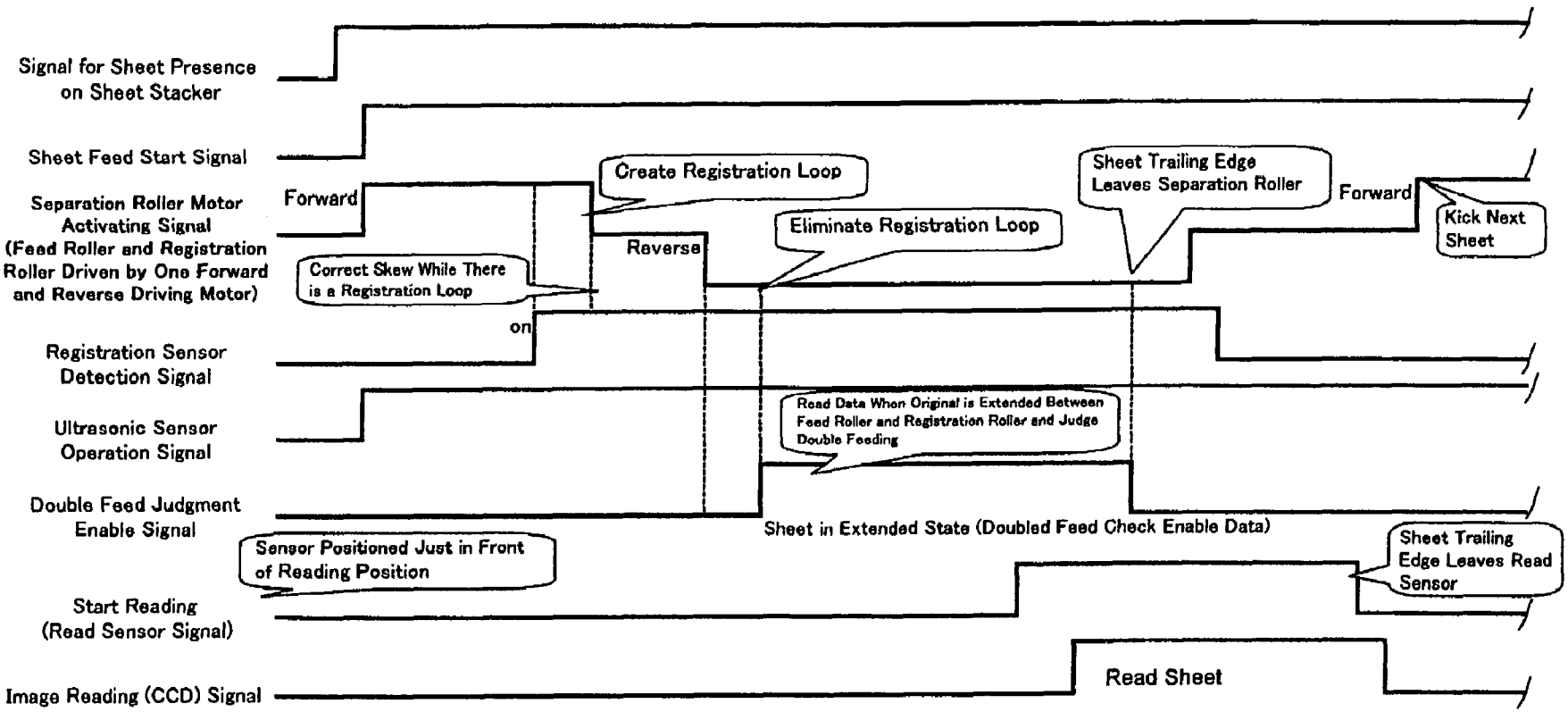
FIG. 4 is a timing chart for controlling an image reading apparatus provided with an ADF.

FIG. 4 is a timing chart for controlling the image reading apparatus 20 provided with an ADF 10. A sheet stacking detection sensor (not shown in the drawings) is disposed for detecting the sheets stacked on the sheet stacker 11 (see FIG. 1). When an image reading start button on the image reading apparatus 20 is pressed while the sheets are stacked on the sheet stacker 11, a sheet feed start signal is generated to start to feed the sheets, as shown in FIG. 4.

Upon the sheet feed start signal, the feed drive motor (not shown in the drawings) rotates in the forward direction, so that the kick roller 1 touches and kicks out the uppermost sheet on the sheets stacker 11 and the separating roller 2*a* is driven to rotate. At this time, the ultrasonic wave sensor 3 is in an operating state. When the separating roller 2*a* starts rotating, the leading edge of the sheet arrives at the register sensor 4. The separating roller 2*a* continues to rotate only for a predetermined period of time after the leading edge of the sheet is detected by the register sensor 4, and then stops. During this time, the pair of register rollers 5 is stopped, so that the sheet is prevented from moving forward to form a loop in the sheet, thereby correcting a skew in the sheet.

Then, at a predetermined timing, the feed drive motor (not shown in the drawings) rotates in reverse to drive the pair of register rollers 5. When the pair of register rollers 5 starts, the separating roller 2*a* stops, so the loop (register loop) formed in the sheet is gradually removed. The register loop is removed after a predetermined period of time after the pair of register rollers 5 starts a rotational drive, and the output signal of the wave receiving sensor 3*b* of the ultrasonic wave sensor 3 is read.

According to the invention, the double feed of the sheets is detected based on the output signal in this state. The output signal of the wave receiving sensor 3*b* is continuously read until the trailing edge of the sheet moves away from the nipping of the separating means 2, thereby accurately detecting the double feed of the sheets.

The CCD (optical reading means) starts to read the image on the sheet after a predetermined period of time after the read sensor 9 detects the leading edge of the sheet passing through the pair of register rollers 5 (see FIG. 1) arranged at an upstream side of the image reading position. The output signal from the CCD (optical reading means) is stored into the memory, and the next sheet stacked on the sheet stacker 11 is kicked out.

Figure 5:
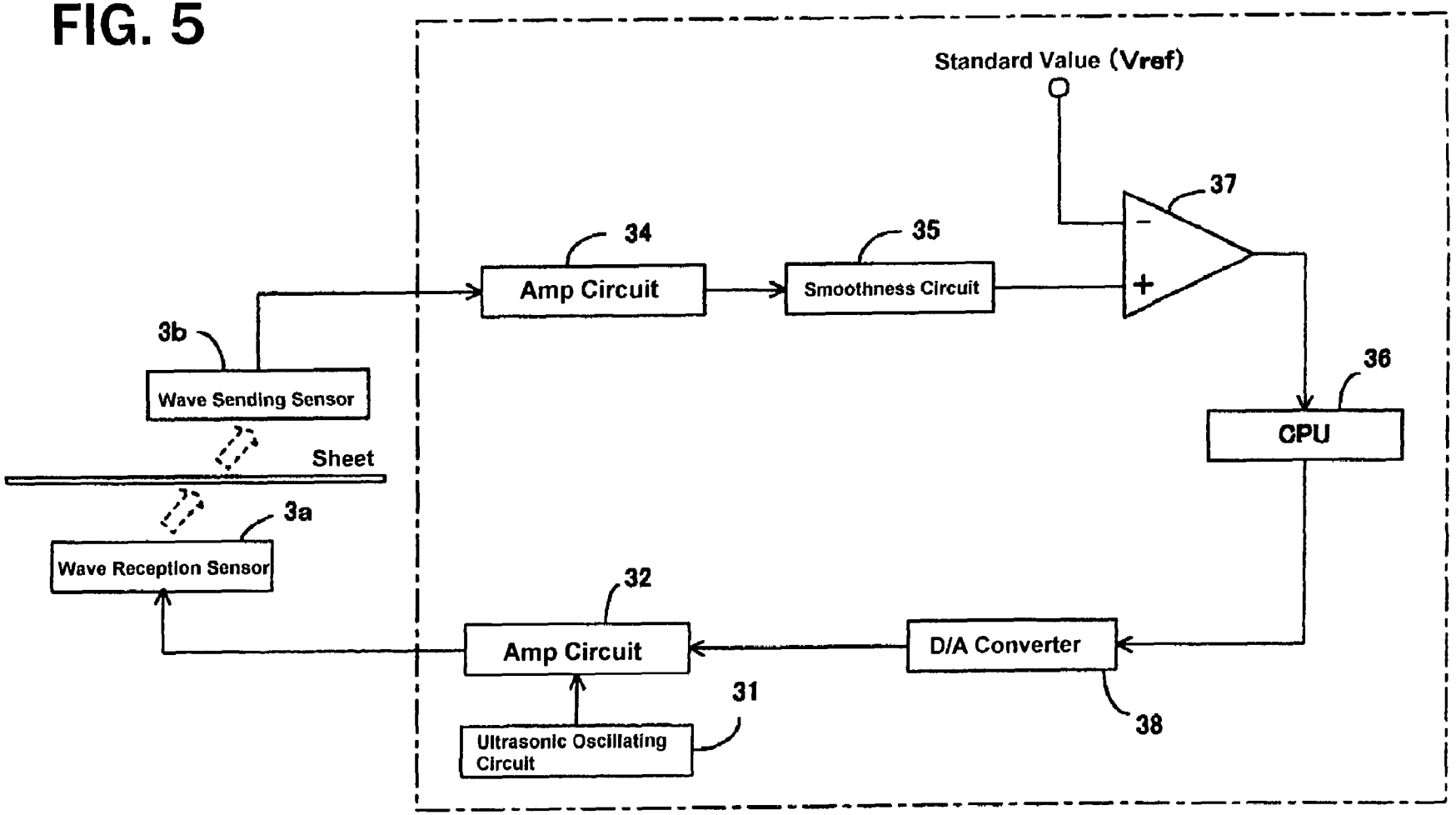
FIG. 5 is a block diagram showing a configuration of a control circuit for processing a signal of the ultrasonic wave sensor.

FIG. 5 is a block diagram showing a configuration of a control circuit for processing the signal of the ultrasonic wave sensor 3. As described above, the ultrasonic wave sensor 3 is composed of the wave sending sensor 3*a* and the wave receiving sensor 3*b*. As shown in FIG. 5, the wave sending sensor 3*a* is driven by an amplifier circuit 32 (amp circuit) that amplifies the ultrasonic wave signal of the ultrasonic wave generator circuit 31 (ultrasonic oscillating circuit). A gain (amplification rate) of the amp circuit 32 that amplifies the ultrasonic wave signal generated by the ultrasonic wave generator circuit 31 is adjusted properly by a CPU 36. The CPU 36 and the amp circuit 32 are connected via a D/A converter 38. It is possible to freely set an output level of the ultrasonic wave signal from the wave sending sensor 3*a*. Accordingly, it is possible to adjust a variation in sensitivity of the sensors (elements), a setting angle relative to the sheet travel surface and a gap between the wave receiving sensor 3*b*, thereby making it possible to set appropriate conditions for detecting the double feed of the sheets.

The amp circuit 34 has a predetermined gain and amplifies the output signal of the wave receiving sensor 3*b*. A smooth circuit 35 (smoothness circuit) rectifies the amplified electrical signal and an integrated circuit with a predetermined time constant smoothes the rectified signal. The electrical signal passing through the smoothness circuit 35 is compared with a predetermined standard value in the comparator circuit 37. A compared value output from the comparator circuit 37 is input to the CPU 36 to judge whether the sheets are double fed. As described above, the judgment of the double feed is performed when the loop formed in the sheet between the separating means 2 and the pair of register rollers 5 is removed, and is continuously performed until the trailing edge of the sheet is no longer nipped by the separating means 2, thereby accurately detecting the double feed of the sheets.

Figure 6A:
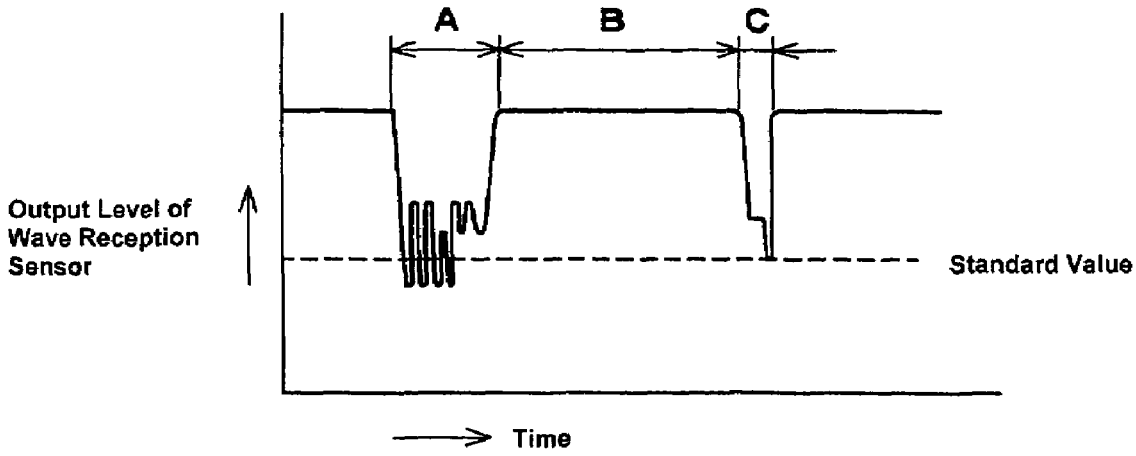
FIGS. 6(*a*) and 6(*b*) are charts showing waveforms of output signals of the wave receiving sensor and a standard value.
Figure 6B:
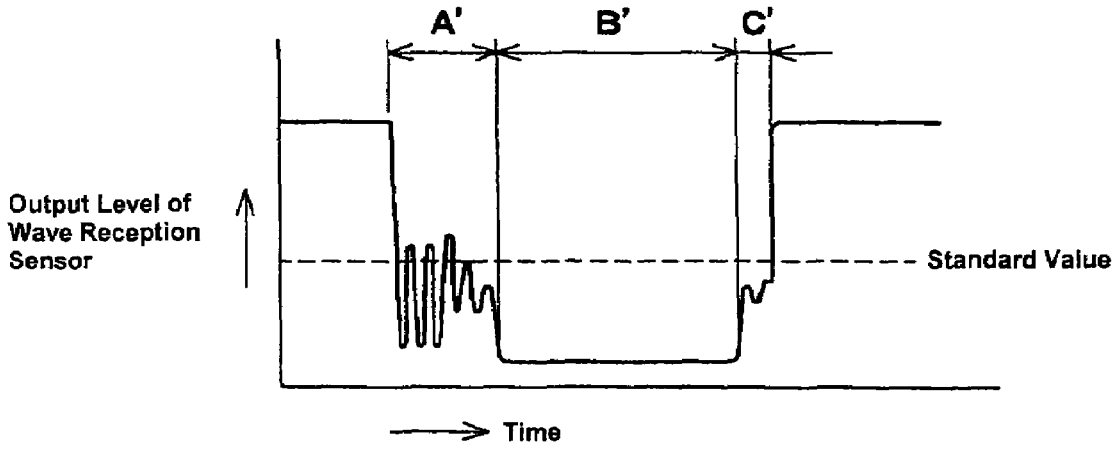

FIGS. 6(*a*) and 6(*b*) show waveforms of the output signals of the wave receiving sensor 3*b* and the standard value. FIG. 6(*a*) shows a waveform when only one sheet is fed, and FIG. 6(*b*) shows a waveform when the sheets are double fed. As shown in FIG. 6(*a*), the output value of the wave receiving sensor 3*b* is higher than the standard value, indicating that only one sheet is kicked out. Conversely, as shown in FIG. 6(*b*), the output value of the wave receiving sensor 3*b* is lower than the standard value, indicating that the sheets are double fed.

As shown in FIG. 6(*a*), the waveform of the output signal from the wave receiving sensor 3*b* has three sections, namely 'A', 'B' and 'C'. The section 'A' shows a state that the level of the ultrasonic wave received by the wave receiving sensor 3*b* is unstable when the sheet has a loop (shown in FIG. 2(*a*)). The section 'B' indicates a state that the output signal of the wave receiving sensor 3*b* is stable when the loop is removed from the sheet and the leading and trailing edges of the sheet are nipped by the separating means 2 and the pair of register rollers 5 (shown in FIG. 2(*b*)). The section 'C' shows a state that the signal of the wave receiving sensor 3*b* is slightly unstable when the trailing edge of the sheet moves away from the separating means 2 and the trailing edge of the sheet is vibrating (shown in FIG. 2(*c*)). According to the invention, the double feed of the sheets is judged based upon the output signal of the wave receiving sensor. 3*b* in the section 'B', thereby accurately detecting the double feed of the sheets.

As described above, the present invention comprises the sheet stacker; the separating means for separating the sheets stacked on the sheet stacker and for feeding the sheets; the register rollers for correcting a skew of the sheets kicked out from the separating means; the ultrasonic wave sensor arranged obliquely relative to the sheet travel surface between the separating means and the register rollers and composed of the wave sending sensor and the wave receiving sensor; the judging means for judging the double feed of the sheets based upon the output signal from the wave receiving sensor; and the control means for controlling the register rollers to stop and rotate. The judging means judges whether the sheets are double fed based upon the output signal from the wave receiving sensor after a predetermined period of time after the register rollers starts to rotate.

Therefore, the invention can apply to the ADF for transporting original sheets to an image reading position, and any general sheet handling apparatus such as a copier for kicking out a single sheet from a paper stacker and feeding the sheet to a printing unit.

According to another embodiment of the invention, a sheet handing apparatus will be explained with reference to the accompanying drawings, in which the leading edge and the trailing edge of the sheet are detected for judging the double feed based on the output signal from the wave receiving sensor of the ultrasonic wave sensor. The ultrasonic wave sensor is composed of the wave sending sensor and the wave receiving sensor and is arranged between the separating means and the register rollers. In the drawings, numeral references same as those in the previous embodiment denote the same components.

Figure 7:
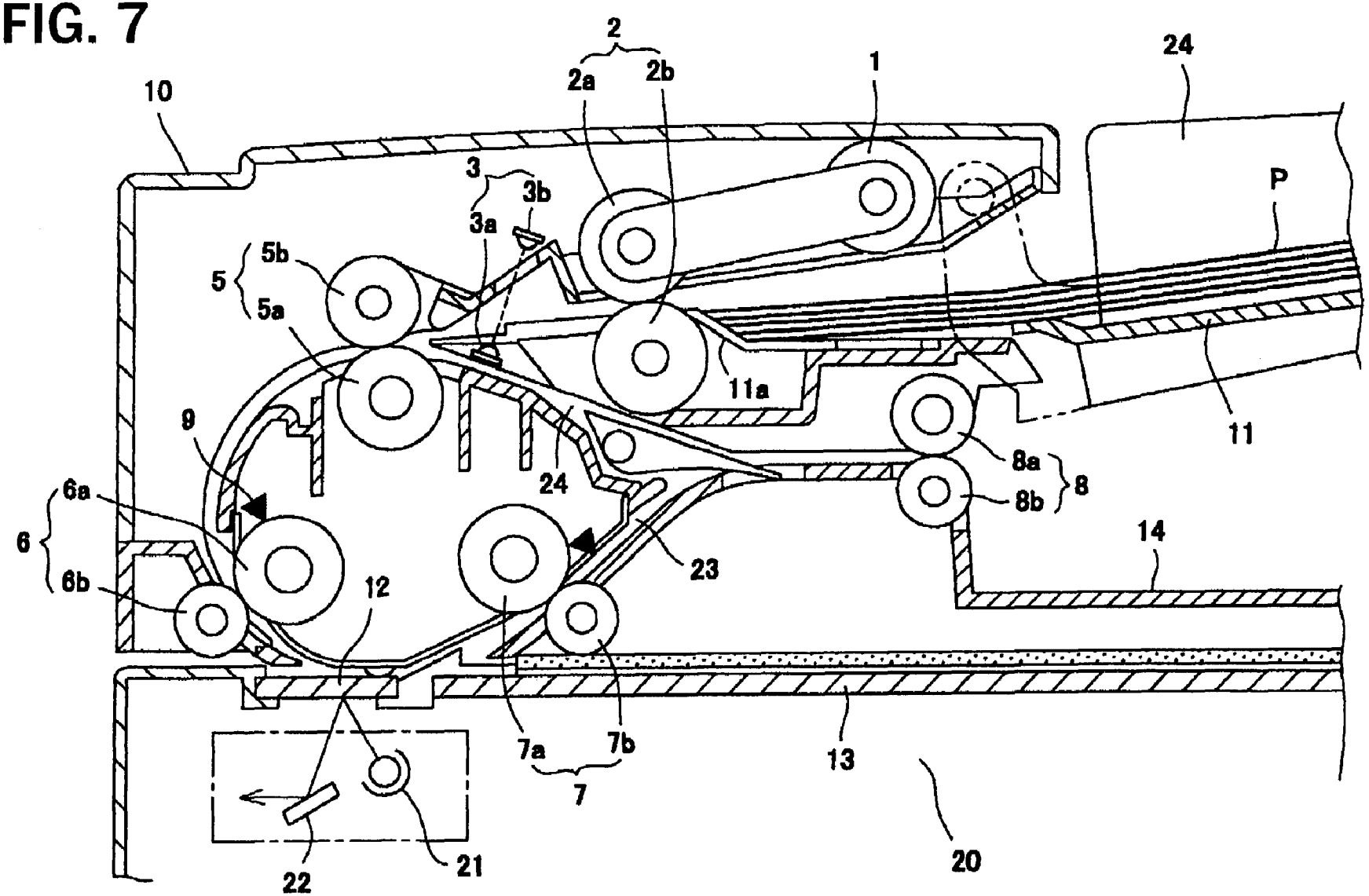
FIG. 7 is a sectional view showing an ADF as a sheet handling apparatus according to the present invention.
Figure 8A:
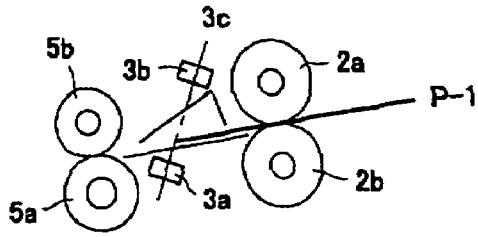
FIGS. 8(*a*) to 8(*e*) are views showing separating means, register rollers and an ultrasonic wave sensor in the sheet handling apparatus.
Figure 8B:
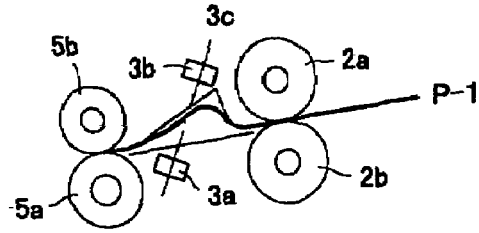
Figure 8C:
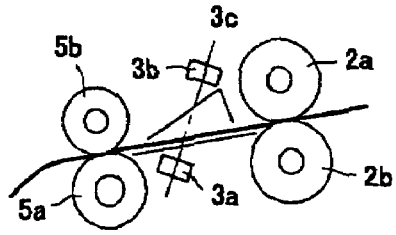
Figure 8D:
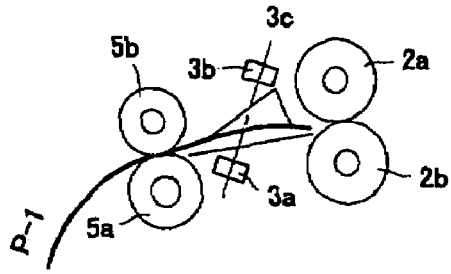
Figure 8E:
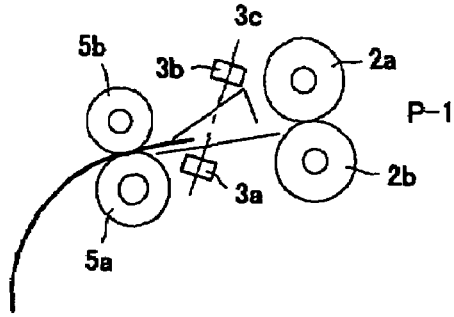

The ADF 10 shown in FIG. 7 has the same configuration as the ADF shown in FIG. 1. In the ADF shown in FIG. 1, the register sensor 4 is disposed at the upstream side of the pair of register rollers 5 for detecting the leading edge of the sheet when the leading edge of the sheet kicked out from the separating means 2 reaches the pair of register rollers 5. On the other hand, in the ADF shown in FIG. 7, it is not necessary to provide the register sensor 4. In the ADF shown in FIG. 7, the ultrasonic wave sensor 3 and the judging means for processing the output signal from the ultrasonic wave sensor 3 detect the leading edge and the trailing edge of the sheet. Also, since the pair of register rollers 5 feeds the sheet at a known speed, it is possible to determine the size of the sheet (length of the sheet in the feed direction).

In the ADF shown in FIG. 1, the register sensor 4 detects the timing when the leading edge of the sheet abuts against the pair of register rollers 5. In the ADF shown in FIG. 7, the ultrasonic wave sensor 3 detects the timing. The sheet interrupts an ultrasonic wave path 3*c* of the ultrasonic wave output from the wave sending sensor 3*a* of the ultrasonic wave sensor 3. Accordingly, when the leading edge of the sheet passes between the wave sending sensor 3*a* and the wave receiving sensor 3*b*, the level of the ultrasonic wave received by the wave receiving sensor 3*b* decreases. The judging means detects the leading edge of the sheet by detecting this timing. In the same way, the trailing edge of the sheet is detected when the level of the ultrasonic wave received by the wave receiving sensor 3*b* increases when the ultrasonic wave path 3*c* is opened.

In the ADF, a loop is formed in the sheet between the pair of register rollers 5 and the separating means 2. After the pair of register rollers 5 starts to rotate from a stopped state, the ultrasonic wave sensor 3 detects the double feed of the sheets based on the output signal of the wave receiving sensor 3*b* after the loop is removed, thereby accurately detecting the double feed of the sheets.

The reading operation of the sheet fed from the pair of register rollers 5 is the same as the ADF shown in FIG. 1, thereby omitting the explanation.

FIGS. 8(*a*) to 8(*e*) are views showing the separating means 2, the pair of register rollers 5 and the ultrasonic wave sensor 3. As described above, the ultrasonic wave sensor 3 is composed of the wave sending sensor 3*a* and the wave receiving sensor 3*b*, and is arranged obliquely relative to the sheet travel surface between the separating means 2 and the pair of register rollers 5 with the surface in between. The wave sending sensor 3*a* is arranged below the sheet travel surface, and the wave receiving sensor 3*b* is arranged above the sheet travel surface. The ultrasonic wave sensor 3 detects the leading edge and the trailing edge of the sheet P-1 and detects the double feeding of the sheets.

The ultrasonic wave sensor 3 is arranged obliquely and sandwiches the sheet travel surface to stabilize the amount of ultrasonic wave received by the wave receiving sensor 3*b*. When the wave sending sensor 3*a* and the wave receiving sensor 3*b* are arranged orthogonally to sandwich the sheet travel surface, the amount of the ultrasonic wave is greatly varied even by a small movement of the sheet, thereby making it difficult to accurately detect the double feeds of the sheets. The wave receiving sensor 3*b* is arranged above the sheet travel surface, so that dust or dirt from the sheet does not accumulate on a surface of the wave receiving sensor 3*b*, thereby maintaining the detection accuracy.

FIG. 8(*a*) shows a state that the leading edge of the sheet P-1 kicked out from the separating means 2 interrupts the ultrasonic wave path 3*c* between the wave sending sensor 3*a* and the wave receiving sensor 3*b* of the ultrasonic wave sensor 3. When the sheet P-1 blocks the ultrasonic wave path 3*c*, a level of the ultrasonic wave received by the wave receiving sensor 3*b* decreases. Accordingly, the judging means detects the leading edge of the sheet P-1 with the timing of the decrease in the level of the ultrasonic wave.

FIG. 8(*b*) shows a state that the register loop is formed in the sheet. The pair of register rollers 5 is controlled to stop when the leading edge of the sheet P reaches the register rollers from the separating means 2. Accordingly, the separating means 2 pushes further the sheet after the leading edge of the sheet P kicked out from the separating means 2 contacts the pair of register rollers 5, so that the loop is formed in the sheet P-1. The shape and the size (diameter) of the loop are not stable, so that the loop is inappropriate for detecting the double feed of the sheets without stabilizing the amount of the ultrasonic wave received by the wave receiving sensor 3*b*.

FIG. 8(*c*) shows a state that the sheet P-l with the loop is straightened out into a straight shape with regard to the travel surface between the separating means 2 and the pair of register rollers 5. After a predetermined period of time after the leading edge of the sheet P contacts the pair of register rollers 5, the pair of register rollers 5 starts to rotate and the separating roller 2*a* of the separating means 2 stops, so that the loop is gradually removed and the sheet is straightened out. At this time, the amount of the ultrasonic wave received by the wave receiving sensor 3*b* is stabilized, thereby providing the optimum timing for detecting the double feed of the sheet P-1. At this time, the sheet P-1 is nipped at the leading and trailing edges thereof by the separating means 2 and the pair of register rollers 5, thereby suppressing vertical vibration or movement. When the sheet P is double fed, a gap is generated between the sheets when the loop is formed therein as shown in FIG. 8(*c*). The gap attenuates the ultrasonic wave, so that the ultrasonic wave sensor 3 is able to accurately detect the double feed of the sheets.

FIG. 8(*d*) shows a state that the sheet P-1 is transported further toward a downstream side by the pair of register rollers 5, and the trailing edge of the sheet P is released from the nip of the separating means 2. In this state, the sheet P-1 flaps and moves up and down around the nipping point of the pair of register rollers 5, so that it is difficult to accurately detect the double feed of the sheets based on the output signal of the wave receiving sensor 3*b*.

FIG. 8(*e*) shows a state that the trailing edge of the sheet passes through the ultrasonic wave path 3*c* between the wave sending sensor 3*a* and the wave receiving sensor 3*b* of the ultrasonic wave sensor 3. The ultrasonic wave path 3*c* interrupted by the sheet P-1 is opened, and the level of the ultrasonic wave received by the wave receiving sensor 3*b* increases. Accordingly, the judging means detects the trailing edge of the sheet P-1 based on the timing of the increase in the level of the ultrasonic wave.

The control device of the ADF shown in FIG. 7 can calculate the size of the sheet (length in the sheet feeding direction) from the time between when the leading edge of the sheet is detected and when the trailing edge of the sheet is detected, a feeding speed of the pair of register rollers 5, and the stopping time of the pair of register rollers 5 while the sheet forms the register loop.

Figure 9:
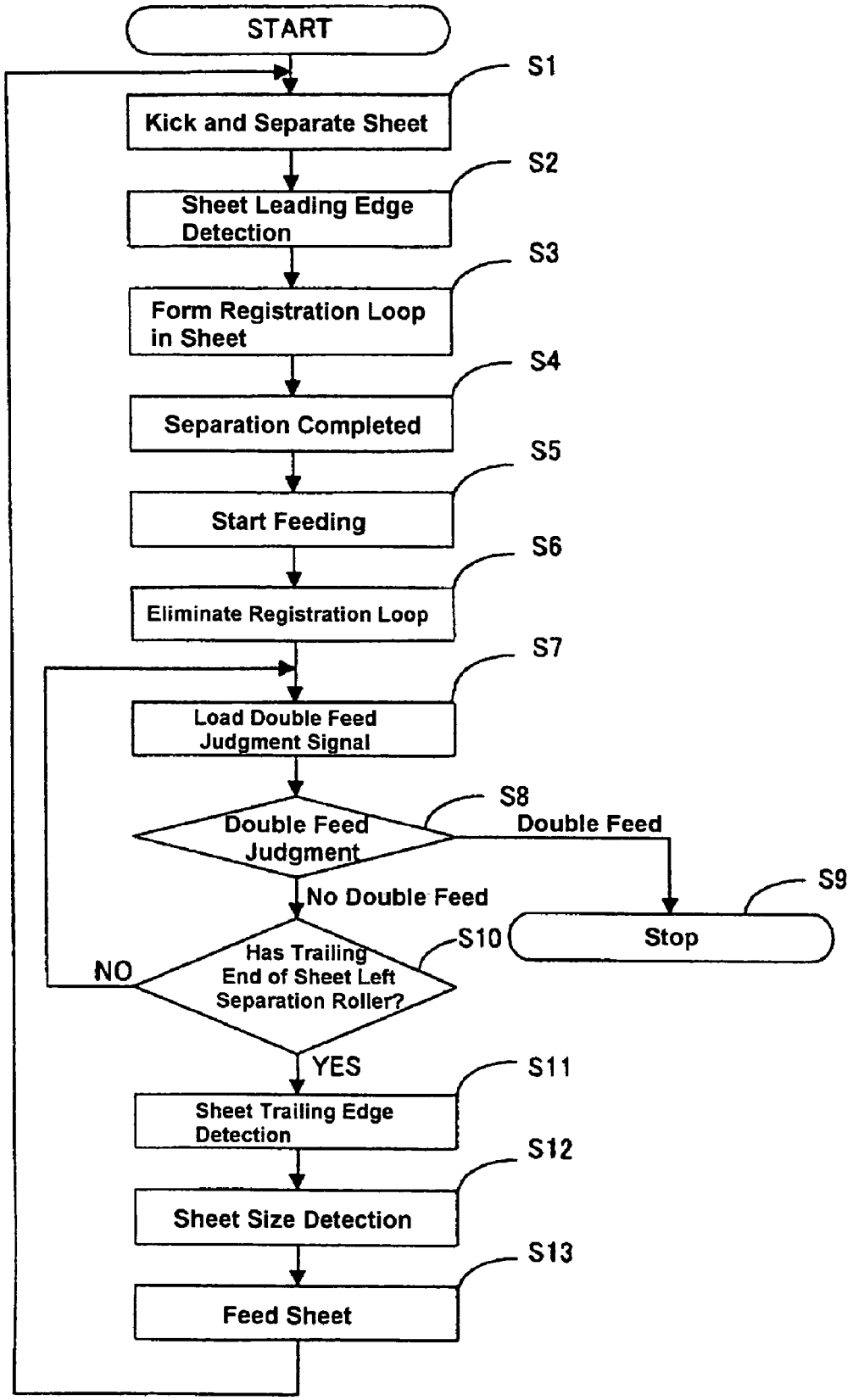
FIG. 9 is a flow chart for explaining timing of reading an output signal of a wave receiving sensor of the ultrasonic wave sensor.

FIG. 9 is a flow chart for explaining timing of reading the output signal of the wave receiving sensor 3*b* of the ultrasonic wave sensor 3, and the flow chart will be explained with reference to FIG. 7. Among the sheets fed from the kick roller 1, only the uppermost single sheet passes through the separating means 2, and the second or subsequent sheets below the uppermost sheet do not pass. The sheet kicked out from the kick roller 1 is fed to the pair of register rollers 5 (S1) . When the sheet interrupts the ultrasonic wave path of the ultrasonic wave sensor 3, it is detected that the leading edge of the sheet reaches a predetermined position (S2).

The pair of register rollers 5 does not rotate when the leading edge of the sheet from the separating means 2 abuts against the register rollers, so that a loop is formed in the sheet at the pair of register rollers 5 (S3). The separating roller 2*b* of the separating means 2 is stopped at this time to stop separating the sheets (S4).

Next, the pair of register rollers 5 is driven to rotate for a predetermined period of time to feed the sheet after the leading edge of the sheet arrives at the pair of register rollers 5 (S5). The loop formed while the pair of register rollers 5 stops is removed from the sheet (S6) to correct a skew in the sheet. At this point, the output signal of the wave receiving sensor 3*b* of the ultrasonic wave sensor 3 is read (S7). Accordingly, it is determined whether the sheets are double fed based on the output signal of the wave receiving sensor 3*b* when the loop is removed from the sheet at the pair of register rollers 5 (S8). When the double feed is detected, the ADF stops (S9). It is also acceptable to continue reading the sheets even if the double feed is detected, and then to display a warning to the operator after reading all the sheets.

When the double feed is not detected, the system continues the judging (S7 and S8) whether the sheets are double fed based on the output signal of the wave receiving sensor 3*b* until the trailing edge of the sheet passes through the separating means 2 (S10), so that the double feed of the sheets is further accurately detected. After the trailing edge of the sheet passes through the separating means 2, the sheet interrupts the ultrasonic waves path of the ultrasonic wave sensor, so that the trailing edge of the sheet is detected (S11). The time from detecting the leading edge of the sheet to detecting the trailing edge of the sheet is determined to calculate the sheet size (length in the sheet feeding direction) (S12). Then, the sheet is fed toward a downstream side, and the next sheet is kicked out and separated.

Figure 10:
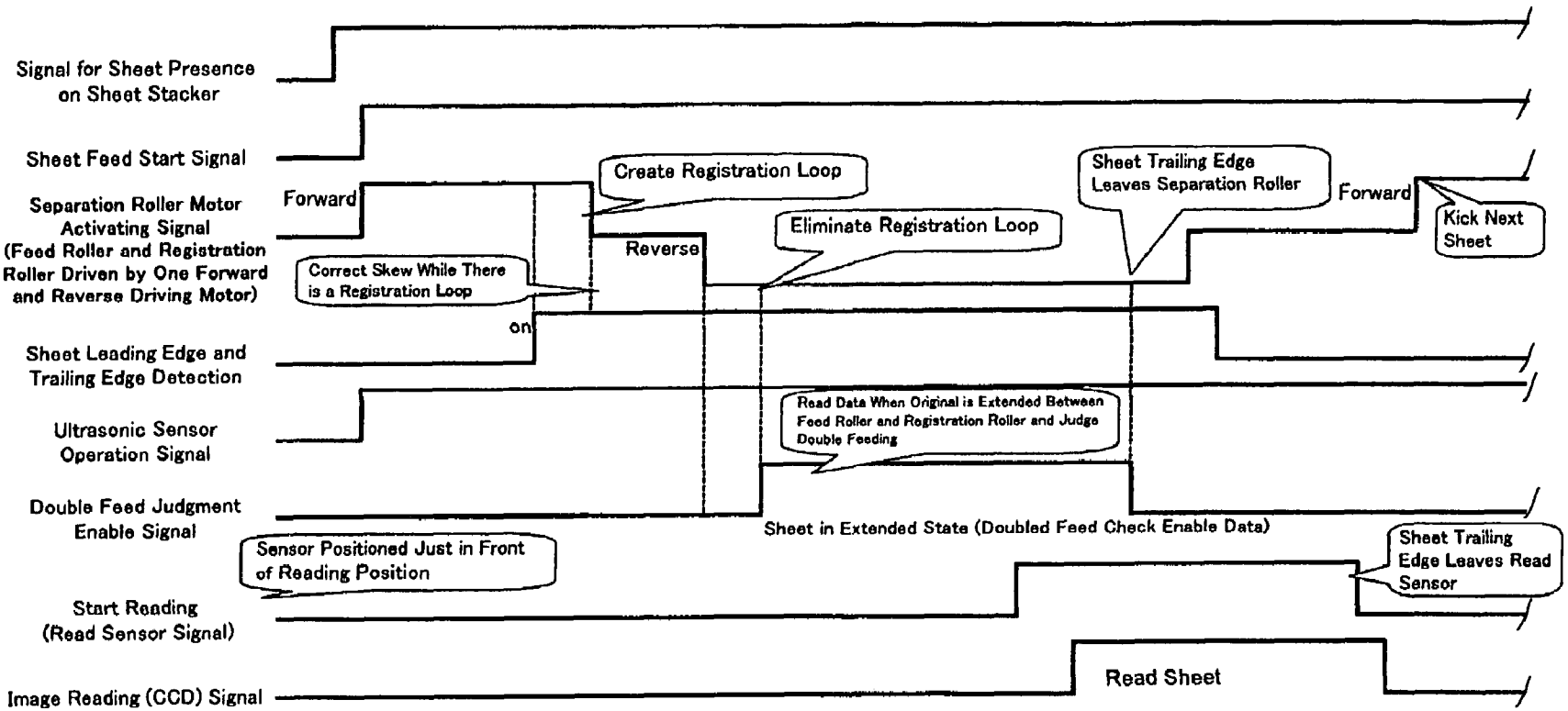
FIG. 10 is a timing chart for controlling an image reading apparatus provided with an ADF.

FIG. 10 is a view showing a timing chart for controlling an image reading apparatus 20 provided with the ADF 10. A sheet stacking detection sensor (not shown in the drawings) is disposed for detecting the sheets stacked on the sheet stacker 11 (see FIG. 7). When the image reading start button on the image reading apparatus 20 is pressed while the sheets are stacked on the sheet stacker 11, the sheet feed start signal is generated to start feeding the sheets, as shown in FIG. 10.

Upon the sheet feed start signal, the feed drive motor (not shown in the drawings) rotates in the forward direction, so that the kick roller 1 contacts the uppermost sheet on the sheet stacker 11. When the sheet is kicked out, the separating roller 2*a* is driven to rotate. At this time, the ultrasonic wave sensor 3 is in an operating state.

When the separating motor 2*a* starts rotational drive, the leading edge of the sheet interrupts the ultrasonic wave path 3*c* (see FIG. 8(*a*)) and the leading edge of the sheet is detected. The separating roller 3*a* continues to rotate only for a predetermined period of time after the leading edge of the sheet is detected, and then stops. During this time, the pair of register rollers 5 is stopped, so that the sheet is prevented from moving forward by the pair of register rollers 5, thereby forming a loop in the sheet and correcting any skew in the sheet.

Then, at a predetermined timing, the feed drive motor (not shown in the drawings) rotates in reverse to rotate the pair of register rollers 5. When the pair of register rollers 5 starts, the separating roller 2*a* stops, and the loop (register loop) formed in the sheet is gradually removed. The register loop is removed after a predetermined period of time after the pair of register rollers 5 starts the rotational drive, and the output signal of the wave receiving sensor 3*b* of the ultrasonic wave sensor 3 is read.

According to the invention, the double feed of the sheets is detected based on the output signal in this state. The reading of the output signal of the wave receiving sensor 3*b* is continuously performed until the trailing edge of the sheet moves away from the nipping of the separating means 2 to accurately detect the double feed. Then, the trailing edge of the sheet passes through the ultrasonic wave path 3*c* (see FIG. 8(*e*)), so that the trailing edge of the sheet is detected. The judging means calculates the size of the sheet (length in the sheet feeding direction) from the time from the detection of the leading edge of the sheet to the detection of the trailing edge of the sheet, the feeding speed of the pair of register rollers 5, and the stopping time of the pair of register rollers 5 while the sheet forms the register loop.

The reading of the images on the sheet is started after a predetermined period of time after the leading edge of the sheet passing through the pair of register rollers 5 is detected by the read sensor 9 (see FIG. 7) arranged at an upstream side of the image reading position. The output signal from the CCD (optical reading means) is stored into the memory. The next sheet stacked on the sheet stacker 11 is kicked out.

Figure 11:
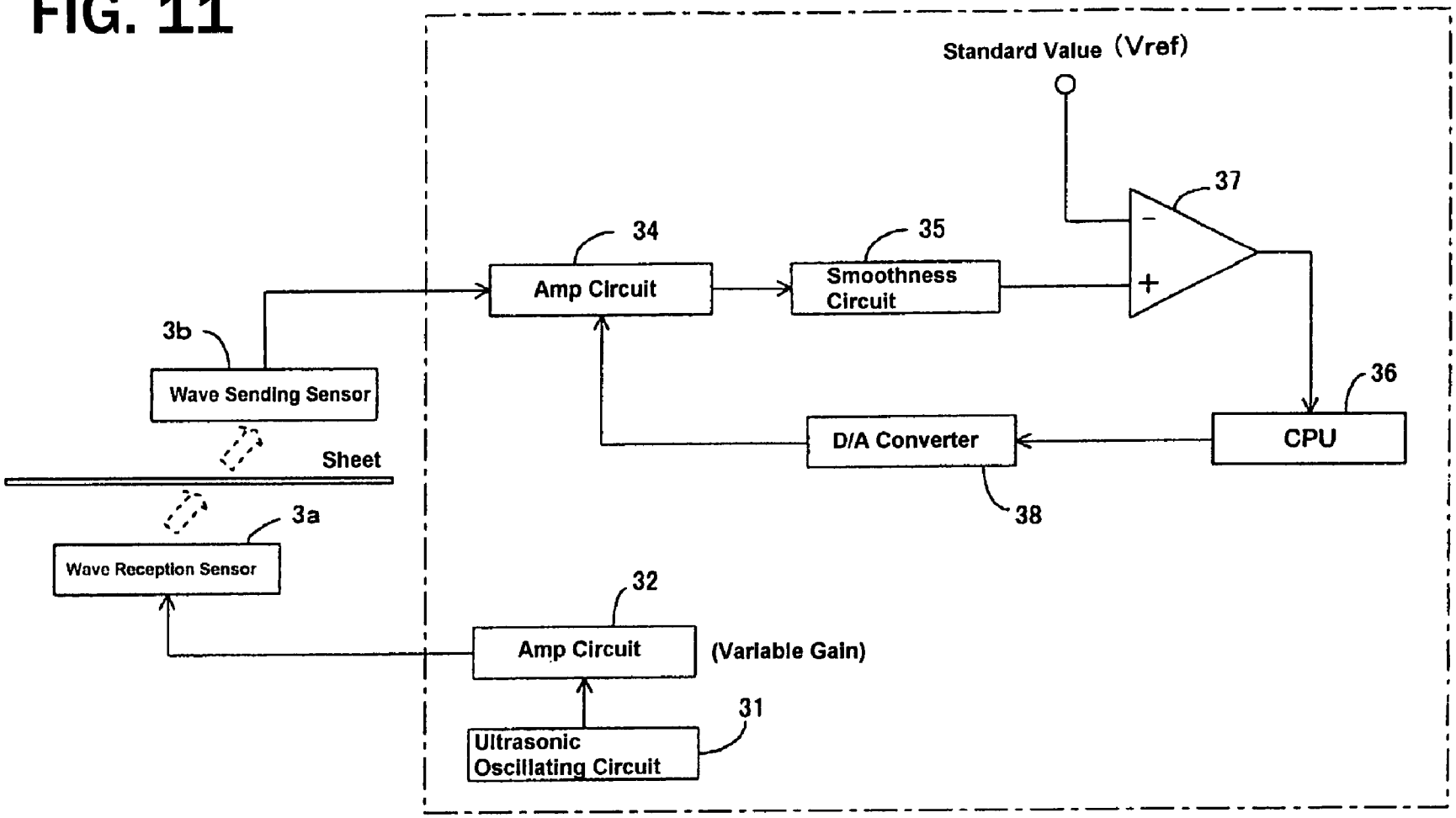
FIG. 11 is a block diagram showing a configuration of a control circuit for processing a signal of the ultrasonic wave sensor according to a first embodiment.

FIG. 11 is a block diagram of a control circuit of the judging means according to a first embodiment of the present invention. As described above, the ultrasonic wave sensor 3 is composed of the wave of sending sensor 3*a* and the wave receiving sensor 3*b*. In the judging means according to the first embodiment, the wave sending sensor 3*a* is driven by an amp circuit 32 that amplifies the ultrasonic wave signal generated by an ultrasonic wave generating circuit 31 (ultrasonic oscillating circuit). A gain (amplification rate) of the amp circuit 32 that amplifies the ultrasonic wave signal generated by the ultrasonic wave generator circuit 31 can be varied using a volume knob to set an output level of the ultrasonic wave from the wave sending sensor 3*a*. Accordingly, it is possible to adjust a difference in sensitivities of the sensors (elements), a setting angle with regard to the sheet travel surface and the gap between the sending sensor 3*a* and the wave receiving sensor 3*b*.

The output signal of the wave receiving sensor 3*b* is amplified by an amp circuit 34. The amplified electrical signal is rectified in a smoothness circuit 35 and then smoothed by an integrated circuit with a predetermined time constant. A CPU 36 and the amp circuit 34 are connected via the D/A converter 38, and a gain of the amp circuit 34 can be set freely using software. The CPU 36 sets each of the output signal gains of the wave receiving sensor 3*b* for detecting the leading edge and the trailing edge of the sheet and detecting the double feed of the sheets. Accordingly, it is possible to precisely detect the leading edge and the trailing edge of the sheet and to detect the double feed of the sheets using one ultrasonic wave sensor 3.

It is acceptable to detect the sheet when detecting the leading edge and the trailing edge of the sheet, so a first gain value is set to be comparatively small. Conversely, when the double feed of the sheets is detected, it is necessary to detect one or more sheets, and a comparatively large second gain value is set.

The electrical signal passes through the smoothness circuit 35, and is compared with a standard value in a comparator circuit 37. The compared value is output from the comparator circuit 37, and is input to the CPU 36. The leading and trailing edges of the sheet and the double feed of the sheets are detected at different timings under different comparison conditions. As described above, the double feed is detected when the loop formed in the sheet between the separating means 2 and the pair of register rollers 5 is removed until the trailing edge of the sheet is no longer nipped by the separating means 2, thereby accurately detecting the double feed of the sheets.

Figure 12:
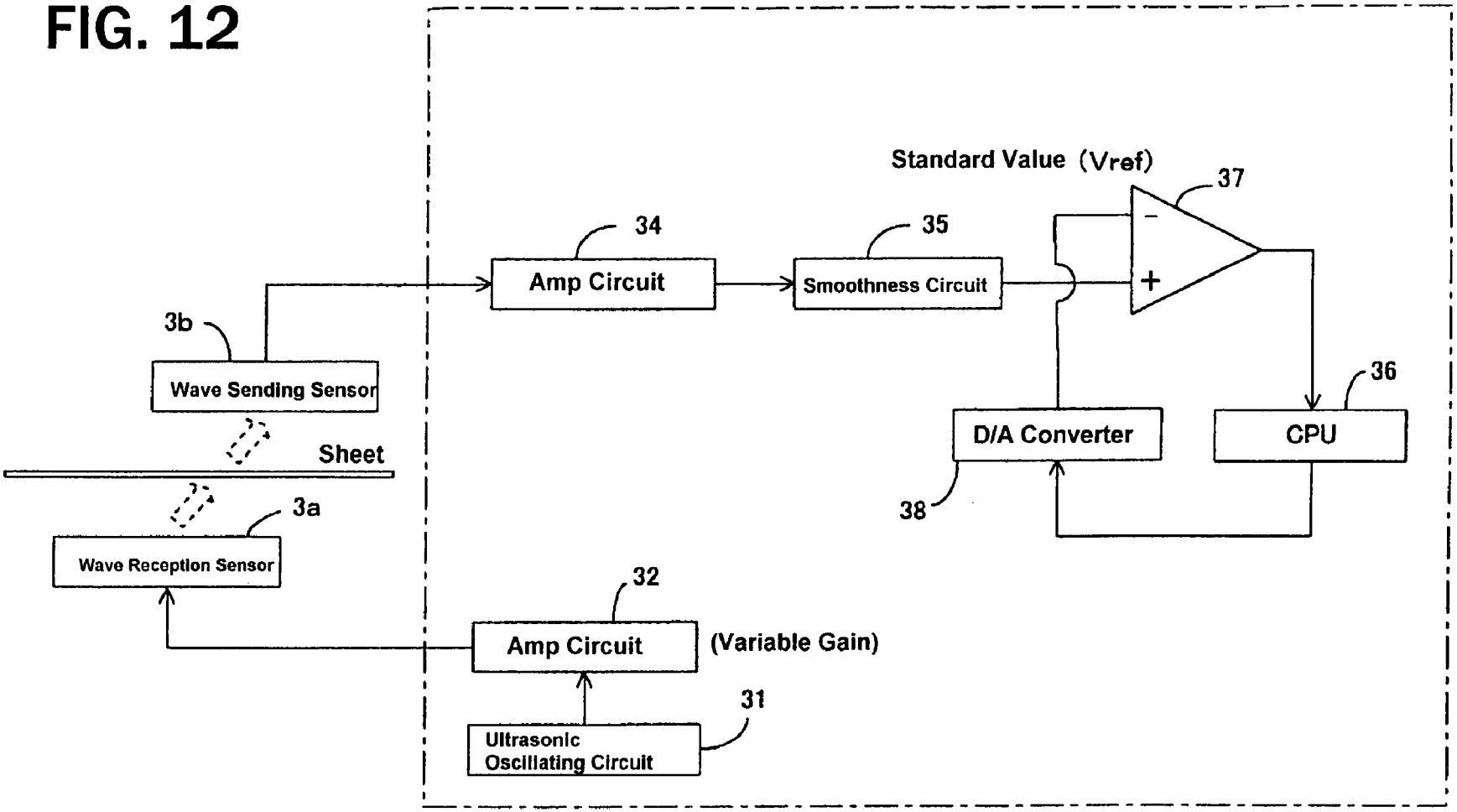
FIG. 12 is a block diagram showing a configuration of a control circuit for processing a signal of the ultrasonic wave sensor according to a second embodiment.

FIG. 12 is a block diagram of a control circuit of the judging means according to a second embodiment of the present invention. A circuit configuration of the wave sending sensor 3*a* of the judging means in the second embodiment is the same as that in the first embodiment shown in FIG. 11. Therefore, an explanation of the configuration is omitted. The output signal of the wave receiving sensor 3*b* is amplified with a predetermined gain set by the amp circuit 34. The amplified electrical signal is rectified in the smoothness circuit 35 and then smoothed by the integrated circuit with a predetermined time constant. The electrical signal passes through the smoothness circuit 35 and is compared with the standard value in the comparator circuit 37.

The CPU 36 and a negative input terminal for the comparator circuit 37 are connected via the D/A converter. The CPU 36 can freely set the standard value to be compared with the output signal of the smoothness circuit 35 in the comparator circuit 36 using software. The CPU 36 sets each of the standard values for comparing the output signals of the wave receiving sensor 3*b* when the leading edge and the trailing edge of the sheet are detected and the double feed of the sheets is detected. Accordingly, it is possible to precisely detect the leading edge and the trailing edge of the sheet and the double feed of the sheets using one ultrasonic wave sensor 3. Specifically, the level of the ultrasonic wave received by the wave receiving sensor 3*b* is relatively high when the leading edge and the trailing edge of the sheet are detected, so that the first standard value is set to be a comparatively high value. Conversely, the level of the ultrasonic wave received by the wave receiving sensor 3*b* is comparatively low when the double feed of the sheets is detected, so that the second standard value is set to be a value smaller than the first standard value.

The compared value is output from the comparator circuit 37 and input to the CPU 36 to detect the leading and trailing edges of the sheet and the double feed of the sheets. The double feed is detected when the loop formed in the sheet between the separating means 2 and the pair of register rollers 5 is removed until the trailing edge of the sheet is no longer nipped by the separating means 2, thereby accurately detecting the double feed of the sheets.

Figure 13:
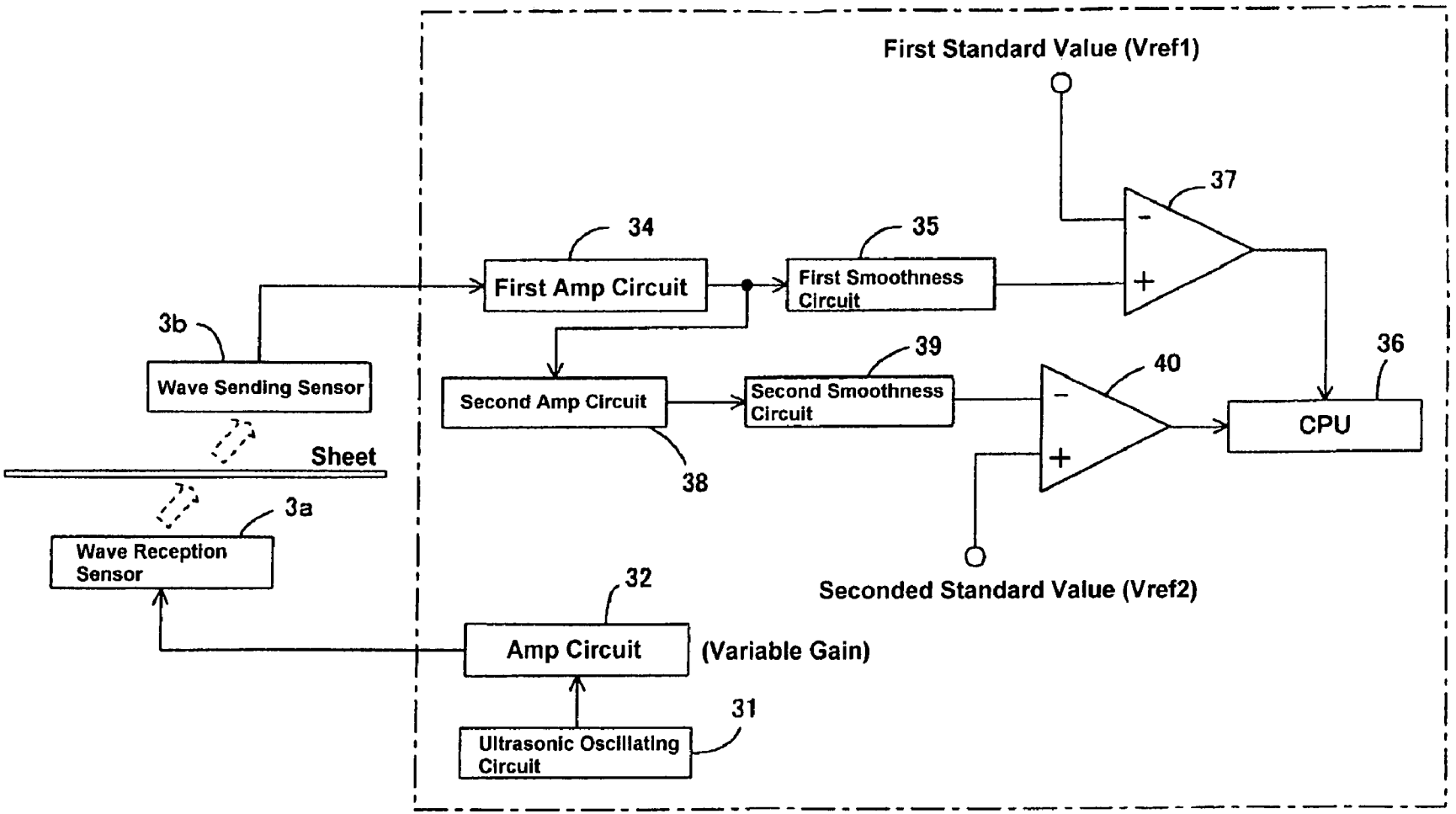
FIG. 13 is a block diagram showing a configuration of a control circuit for processing a signal of the ultrasonic wave sensor according to a third embodiment.

FIG. 13 is a block diagram of a control circuit of the judging means according to a third embodiment of the present invention. The circuit configuration of the wave sending sensor 3*a* of the judging means in the third embodiment is the same as that in the first embodiment shown in FIG. 11. Therefore, the explanation thereof is omitted.

The output signal of the wave receiving sensor 3*b* is first amplified with a predetermined gain preset by the first amplifier circuit 34. Then, the output signal of the first amp circuit 34 is rectified in the first smoothness circuit 35, and then smoothed by the integrated circuit with a predetermined time constant. The output signal of the smoothness circuit 35 is compared with the first standard value in the first comparator circuit 37. The output signal of the first amp circuit 34 is input also to the second amp circuit 38 to be further amplified with a predetermined gain. The output from the second amp circuit 38 is rectified in the second smoothness circuit 39 and then smoothed by the integrated circuit with a predetermined time constant. The output signal of the second smoothness circuit 29 is compared with the second standard value different from the first standard value in the second comparator circuit 40.

The CPU 36 detects the leading edge and the trailing edge of the sheet based upon the input signal from the first comparator circuit 37. The double feed of the sheets is detected based upon the output signal from the second comparator circuit 40. The double feed is detected when the loop formed in the sheet between the separating means 2 and the pair of register rollers 5 is removed until the trailing edge of the sheet is no longer nipped by the separating means 2, thereby accurately detecting the double feed of the sheets.

Figure 14:
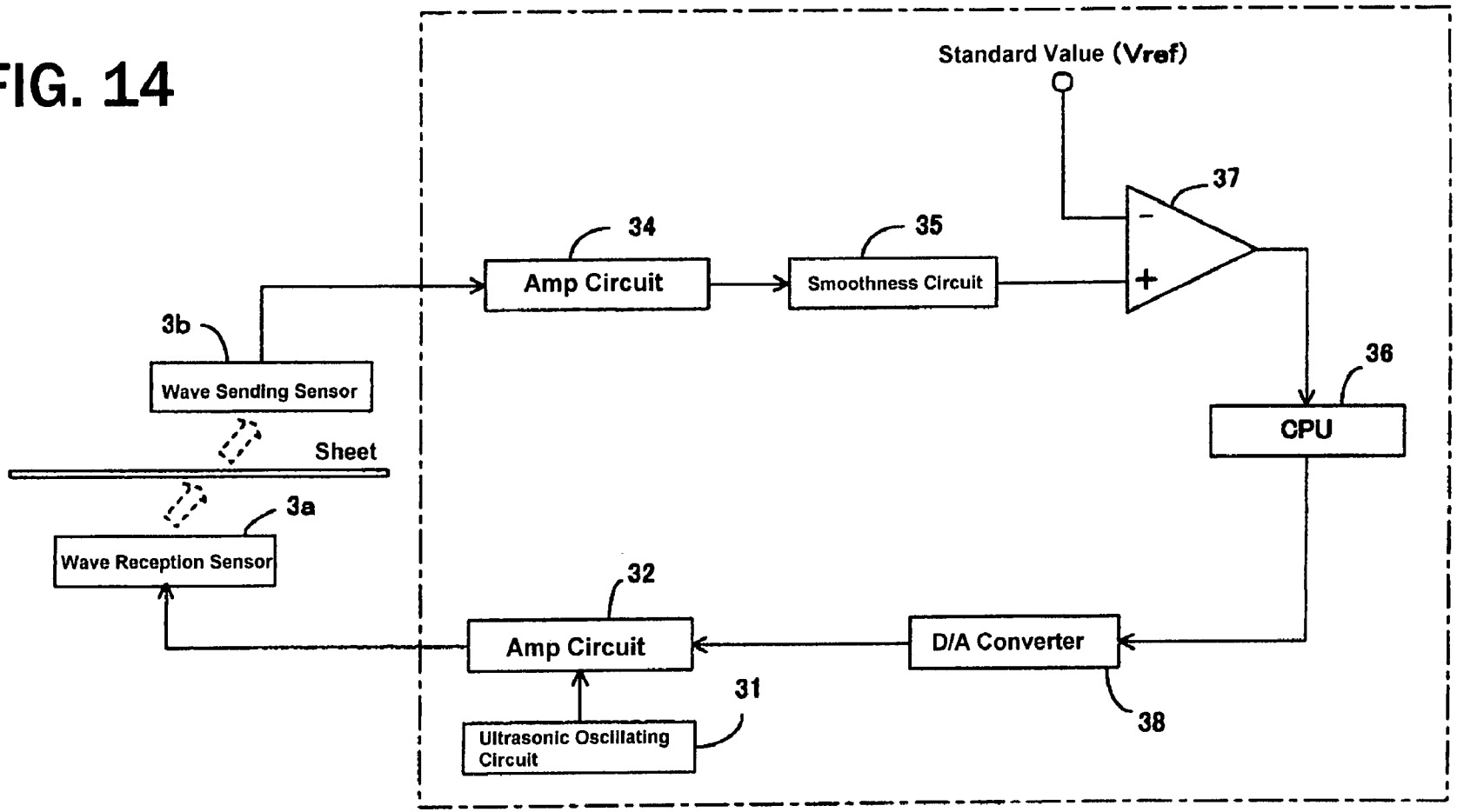
FIG. 14 is a block diagram showing a configuration of a control circuit for processing a signal of the ultrasonic wave sensor according to a fourth embodiment.

FIG. 14 is a block diagram of a control circuit of the judging means according to a fourth embodiment of the present invention. In the judging means according to the fourth embodiment, the wave sending sensor 3*a* is driven by the amp circuit 32 that amplifies the ultrasonic wave signal generated by the ultrasonic wave generating circuit 31 (ultrasonic oscillating circuit). The gain (amplification rate) of the amp circuit 32 that amplifies the ultrasonic wave signal by the ultrasonic wave generating circuit 31 can be set freely by the CPU 36. The D/A converter 38 converts the digital signal output from the CPU 36 into an analog signal and inputs the analog signal into the amp circuit 32, and is connected between the CPU 36 and the amp circuit 32. With this configuration, when the leading and trailing edges of the sheet are detected and the double feed of the sheets is detected, the CPU sets the output levels of the ultrasonic wave outputs from the wave receiving sensor 3*b* to individual and different values. Accordingly, the CPU 36 can freely set the output levels of the ultrasonic waves from the wave sending sensor 3*a*, and it is possible to adjust for the difference in sensitivities of the sensors (elements), the setting angle with regard to the sheet travel surface and the gap between the wave sending sensor 3*a* and the wave receiving sensor 3*b*.

The output signal of the wave receiving sensor 3*b* is amplified by the amp circuit 34 with a predetermined gain. The amplified electrical signal is rectified in the smoothness circuit 35 and smoothed by the integrated circuit with a predetermined time constant.

The electrical signal passes through the smoothness circuit 35, and is compared with the standard value in the comparator circuit 37. The compared value output from the comparator circuit 37 is input to the CPU 36. When the leading edge and the trailing edge of the sheet are detected, the gain of the amp circuit 32 is set to be a comparatively small value. Conversely, when the double feed of the sheets is detected, the gain of the amp circuit 32 is set to be a comparatively high value. Accordingly, it is possible to detect the leading and trailing edges of the sheet and the double feeds of the sheets using one ultrasonic wave sensor 3. The double feed is detected when the loop formed in the sheet between the separating means 2 and the pair of register rollers 5 is removed until the trailing edge of the sheet is no longer nipped by the separating means 2, thereby accurately detecting the double feed of the sheets.

Figure 15:
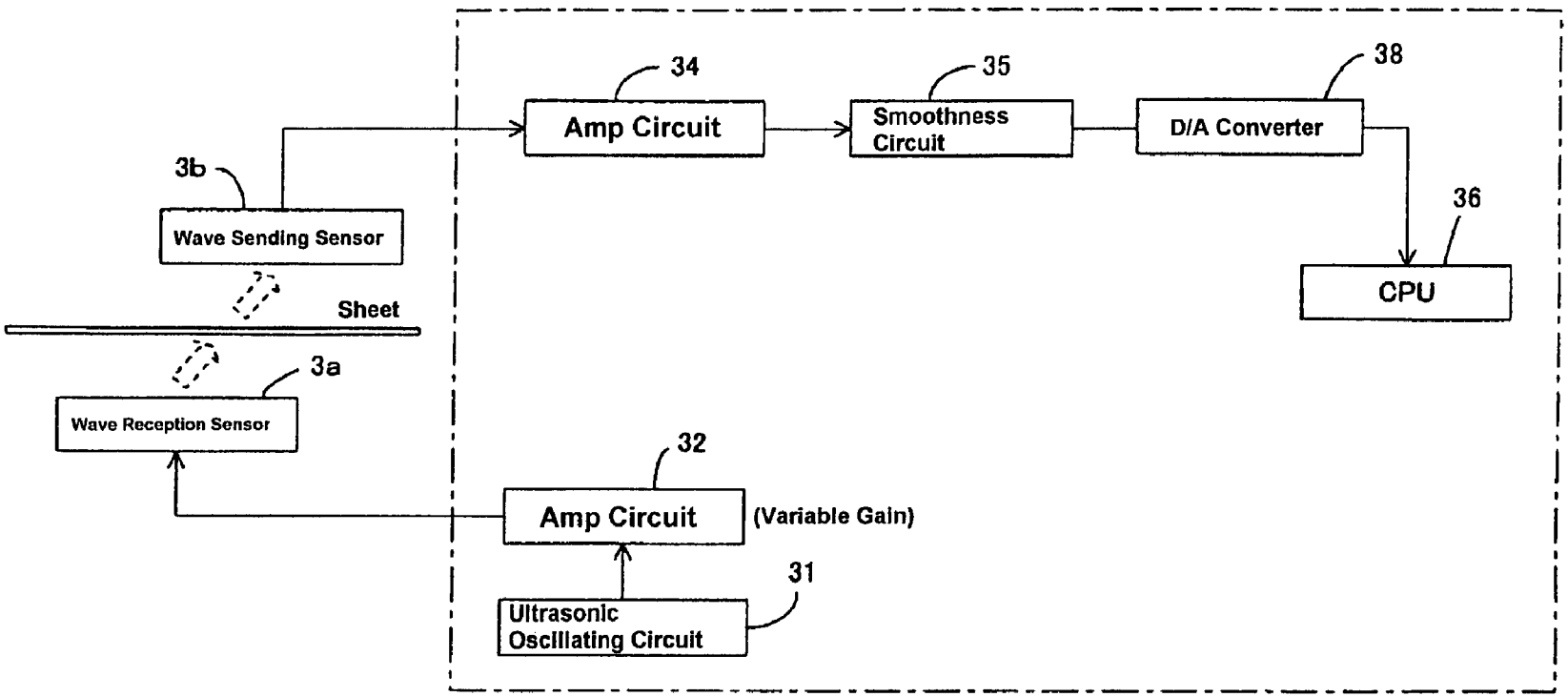
FIG. 15 is a block diagram showing a configuration of a control circuit for processing a signal of the ultrasonic wave sensor according to a fifth embodiment.

FIG. 15 is a block diagram of a control circuit of the judging means according to a fifth embodiment of the present invention. The circuit configuration of the wave sending sensor 3*a* of the judging means in the fifth embodiment is the same as that in the first embodiment shown in FIG. 11. Therefore, the explanation thereof is omitted.

The output signal of the wave receiving sensor 3*b* is amplified by the amp circuit 34. The amplified electrical signal is rectified in the smoothness circuit 35 and then smoothed by the integrated circuit with a predetermined time constant. The analog signal output from the smoothness circuit 35 is converted into the digital signal in the A/D converter 38. The digital signal is read directly by the CPU-36. The two comparison standard values (ranges) for detecting the leading and trailing edges of the sheet and the double feed of the sheets are stored in the CPU 36. When the leading edge and the trailing edge of the sheet are detected, a comparatively high comparison standard value and the digital signal from the A/D converter 38 are compared. When the double feed of the sheets is detected, a comparatively small comparison standard value (range) and the digital signal from the A/D converter 38 are compared. The double feed is detected when the loop formed in the sheet between the separating means 2 and the pair of register rollers 5 is removed until the trailing edge of the sheet is no longer nipped by the separating means 2, thereby accurately detecting the double feed of the sheets.

Figure 16A:
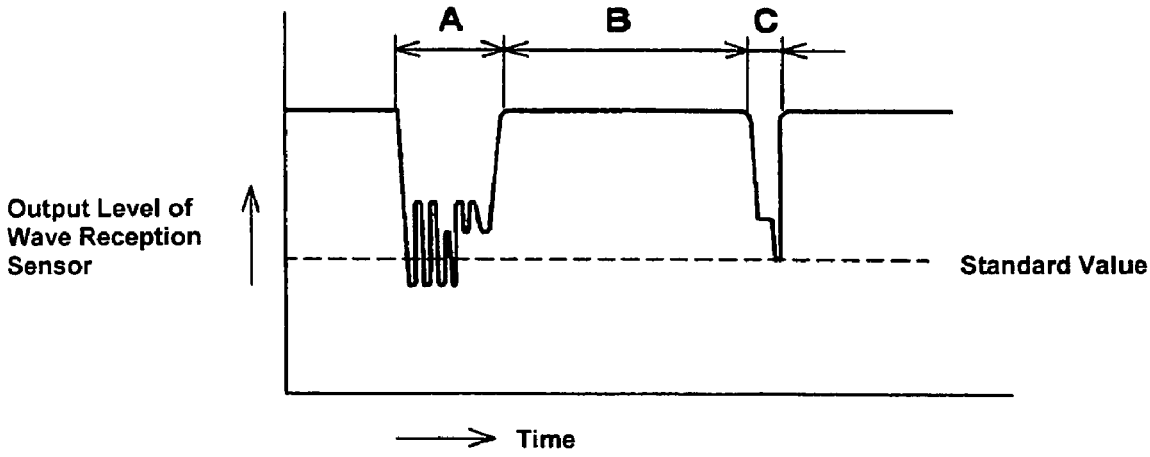
FIGS. 16(*a*) and 16(*b*) are charts showing waveforms of output signals of the wave receiving sensor and a standard value when double feed of sheets is detected.
Figure 16:
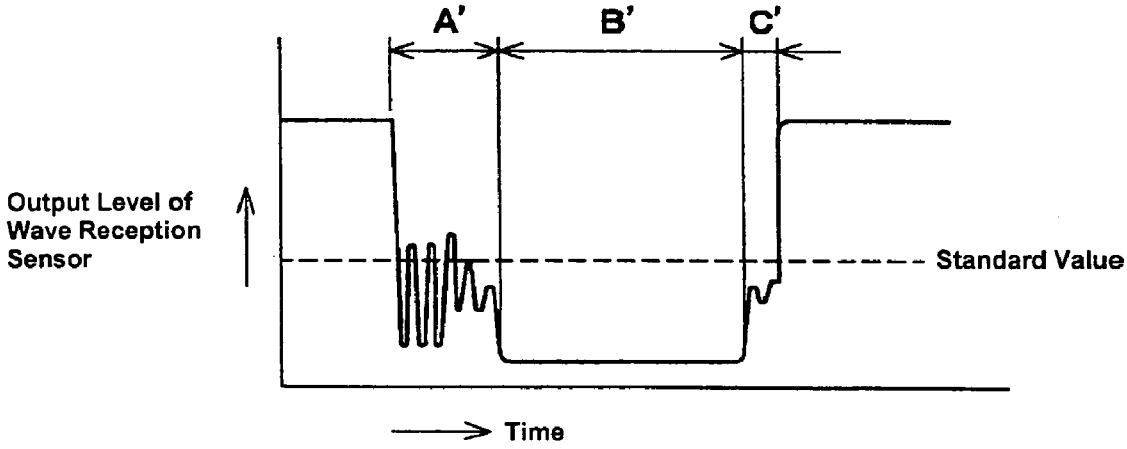

FIGS. 16(*a*) and 6(*b*) are views showing waveforms of the output signals of the wave receiving sensor 3*b* and the standard value when the double feed of the sheets is detected, which is more difficult than detecting the leading edge and the trailing edge of the sheet (detecting the sheet). When the leading edge and the trailing edge of the sheet are detected, the level of the output signal from the wave receiving sensor 3*b* is compared with the standard value.

FIG. 16(*a*) shows a state that only one sheet is fed when the double feed of the sheets is detected, and FIG. 16(*b*) shows s state that the sheets are double fed. As shown in FIG. 16(*a*), the output value of the wave receiving sensor 3*b* is higher than the standard value, indicating that only one sheet is kicked out. Conversely, as shown in FIG. 16(*b*), the output value of the wave receiving sensor 3*b* is lower than the standard value, indicating that the double feed occurs.

As shown in FIG. 16(*a*), the wave form of the output signal from the wave receiving sensor 3*b* is separated into three sections, namely 'A', 'B', and 'C'. The section 'A' shows when the sheet has a loop (see FIG. 8(*b*)), and the level of the ultrasonic wave received by the wave receiving sensor 3*b* is unstable. The section 'B' shows when the loop is removed from the sheet and the leading and trailing edges of the sheet are nipped by the separating means 2 and the pair of register rollers 5 (see FIG. 8(*c*)). In the section 'B', the output signal of the wave receiving sensor 3*b* is stable. The section 'C' shows when the trailing edge of the sheet is released by the separating means 2 (see in FIG. 8(*d*)), and the trailing edge of the sheet is vibrating and the signal of the wave receiving sensor 3*b* is slightly unstable. According to the invention, the double feed of the sheets is detected based upon the output signal of the wave receiving sensor 3*b* in the section 'B', thereby accurately detecting the double feed of the sheets.

Figure 17:
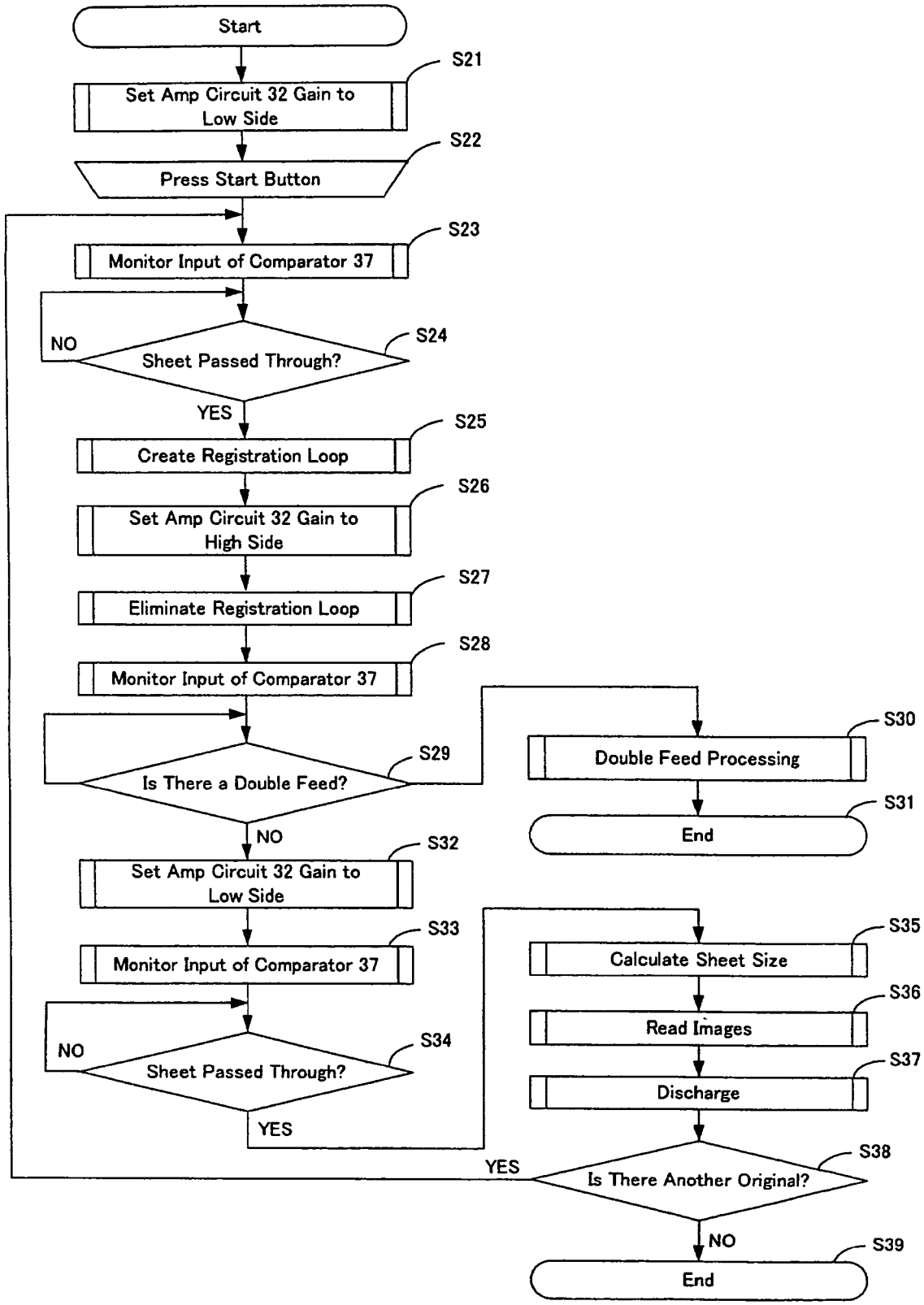
FIG. 17 is a flow chart showing a control process of judging means according to the first embodiment.

FIG. 17 is a control flow chart for detecting the leading and trailing edges of the sheet and the double feed of the sheets with one ultrasonic wave sensor using the judging means according to the first embodiment shown in FIG. 11. The gain of the amp circuit is set to be the first gain value for detecting the leading edge and the trailing edge of the sheet, and the gain of the amp circuit is set to be the second gain value for detecting the double feed.

The CPU 36 (see FIG. 11) sets the gain of the amp circuit 34 stored in advance in predetermined addresses in the memory (included on the CPU 36) as the first gain value, i.e. the low value (S21). When the start button on the apparatus (S22) is pushed, the sheet feed control is started. The CPU 36 monitors the output of the comparator circuit 37 to detect whether the leading edge of the sheet interrupts the ultrasonic wave path 3*c* of the ultrasonic wave sensor 3 by comparing the output with the first gain value (S23). After it is determined that the leading edge of the sheet interrupts the ultrasonic wave path 3*c* (S24), the leading edge of the sheet stops at the pair of register rollers 5 and the register loop is formed in the sheet (S25).

The CPU 36 sets the gain of the amp circuit 34 stored in advance in predetermined addresses in the memory (included on the CPU 36) as the second gain value, i.e. the high value (S26). The register loop in the sheet is removed by the pair of register rollers rotating after a predetermined period of time (S28). The CPU 36 monitors the output from the comparator circuit 37 (S28) and when the sheet is in the state shown in FIG. 8(*c*), the double feed of the sheets is detected based upon the output signal of the comparator circuit 37 (S29). At this time, the comparator circuit 37 outputs the compared signal between the first gain value and the output of the smoothness circuit 35 to the CPU 36. When the double feed of the sheets is detected, the double feed process, i.e. stopping the sheet or the image reading operation, is performed (S30), and the apparatus control is stopped (S31).

When it is judged that only one sheet is fed normally, the control continues. The CPU 36 sets the gain of the amp circuit 34 stored in a predetermined addressed in the memory (included on the CPU 36) to the first gain value, i.e. the low value. Next, the CPU 36 monitors the output of the comparator circuit 37 to detect whether the trailing edge of the sheet interrupts the ultrasonic wave path 3*c* of the ultrasonic wave sensor 3 by comparing the output with the first gain value (S33). After it is determined that the trailing edge of the sheet interrupts the ultrasonic wave path 3*c* (S34), the size of the sheet is calculated by the CPU (S35). The CPU 36 can calculate the size of the sheet (length in the sheet feeding direction) from the time from detecting the leading edge of the sheet to detecting the trailing edge of the sheet, the feeding speed of the pair of register rollers 5, and the stopping time of the pair of register rollers 5 while the register loop is formed.

The sheet is then transported over the platen 12 (see FIG. 7) arranged at a downstream side. The image on the sheet is read by the optical reading means (S36) and then the sheet is discharged to the discharge path 23 (S37). The control described above is performed until all the sheets stacked on the sheet stacker are fed (S38 and S39).

Figure 18:
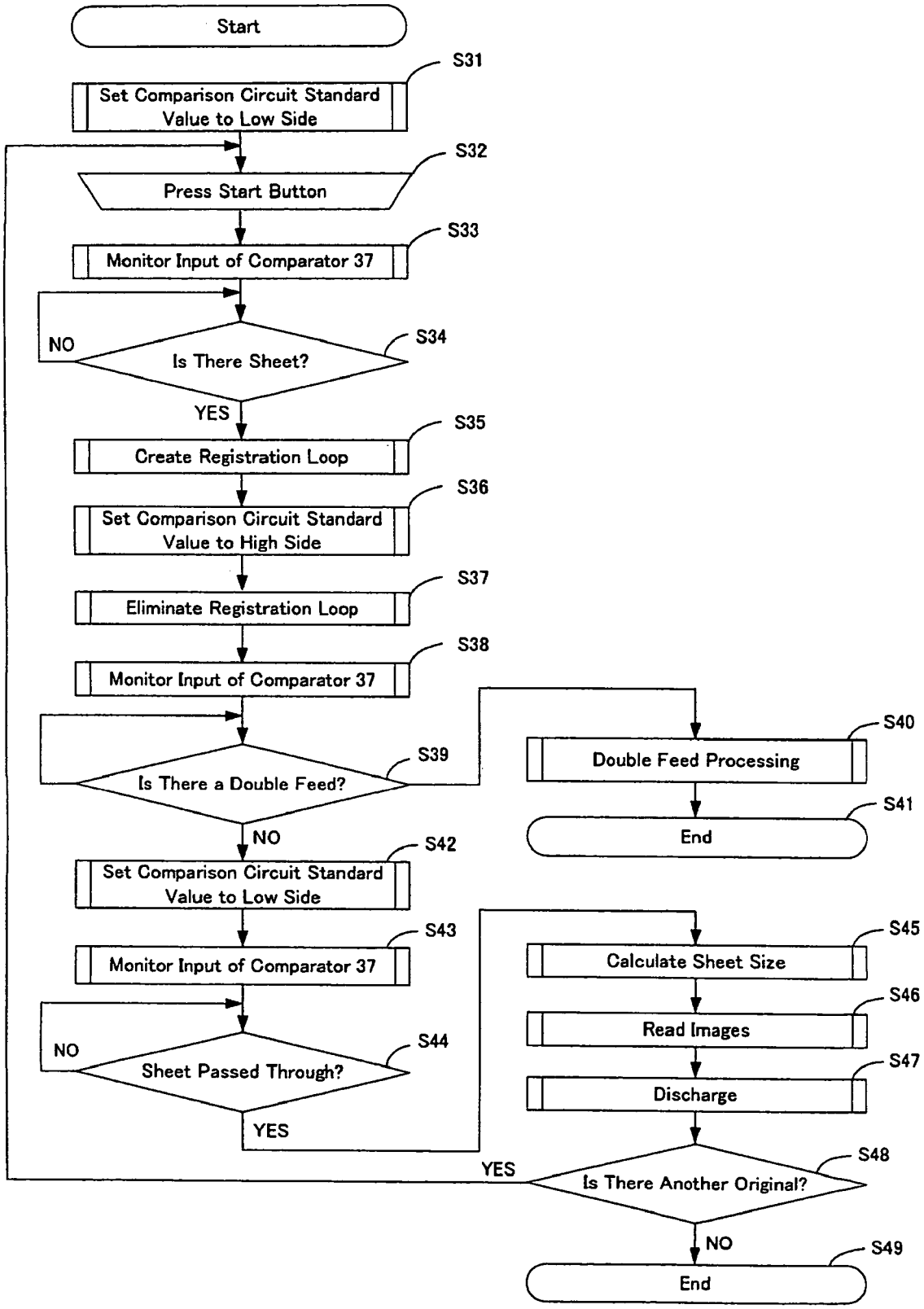
FIG. 18 is a flow chart showing a control process of judging means according to the second embodiment.

FIG. 18 shows a control flow chart for detecting the leading and trailing edges of the sheet and the double feed with one ultrasonic wave sensor using the judging means according to the second embodiment shown in FIG. 12. The standard value for comparison in the comparator circuit 37 is set to be the first standard value for detecting the leading edge and the trailing edge of the sheet, and is set to be the second standard value for detecting the double feed.

The CPU 36 (see FIG. 11) sets the standard value input to one of the input terminals (negative) of the comparator circuit 37 and stored in advance in a predetermined address in the memory (included in the CPU 36) as the first standard value, i.e. the low value (S31). When the operation start button on the apparatus is pushed (S32), the sheet feed control is started. The CPU 36 monitors the output of the comparator circuit 37 to detect whether the leading edge of the sheet interrupts the ultrasonic wave path 3*c* of the ultrasonic wave sensor 3 by comparing the output with the first standard value (S33). After it is determined that the leading edge of the sheet interrupts the ultrasonic wave path 3*c* (S34), the leading edge of the sheet stops at the pair of register rollers 5 and the register loop is formed in the sheet (S35).

Then, the CPU 36 sets the standard value input to the comparator circuit 37 and stored in advance in a predetermined address in the memory (included on the CPU 36) to be the second standard value, i.e. the higher value than the first standard value (S36). The register loop in the sheet is removed by the register rollers rotating after a predetermined period of time (S38). The CPU 36 monitors the output from the comparison circuit 37 (S38) and when the sheet is in the state shown in FIG. 8(*c*), the double feed of the sheets is detected based upon the output signal of the comparator circuit 37 (S39). At this time, the comparator circuit 37 compares the output from the smoothness circuit 35 with the second standard value and outputs the result to the CPU 36. When the double feed of the sheets is detected, a double feed process, i.e. stopping the sheets or the image reading operation, is performed (S40), and the sheet feed control or image reading control is stopped (S41).

When it is determined that only one sheet is fed normally, the control continues. The CPU 36 sets the standard value input to the comparator circuit 37 and stored in a predetermined address in the memory (included on the CPU 36) to be the first standard value, i.e. the low value (S42). Next, the CPU 36 monitors the output of the comparator circuit 37 to detect whether the trailing edge of the sheet interrupts the ultrasonic wave path 3*c* of the ultrasonic wave sensor 3 by comparing the output with the first standard value (S43). After it is determined that the trailing edge of the sheet interrupts the ultrasonic wave path 3*c* (S44), the size of the sheet is calculated by the CPU (S45). The CPU 36 can calculate the size of the sheet (length in the sheet feeding direction) from the time from detecting the leading edge of the sheet to detecting the trailing edge of the sheet, the feeding speed of the pair of register rollers 5, and the stopping time of the pair of register rollers 5 while the register loop is formed.

The sheet is then transported over the platen 12 (see FIG. 7) arranged at a downstream side. The image on the sheet is read by the optical reading means (S36), and the sheet is discharged to the discharge path 23(S47). The control described above is performed until all the sheets stacked on the sheet stacker are fed (S48 and S49).

As described above, according to the invention, the sheet handling apparatus includes the sheet stacker; the separating means for separating and kicking out the sheets stacked on the sheet stacker; the register rollers for correcting any skew of the sheets kicked out from the separating means; the ultrasonic wave sensor composed of the wave sending sensor and the wave receiving sensor arranged between the separating means and the register rollers; and the judging means for detecting the trailing edge and the leading edge of the sheets and for detecting the double feed of the sheets based on the output signal from the wave receiving sensor. By detecting the leading edge and the trailing edge of the sheets, it is possible to determine the size of the sheet (length of the sheets in the feeding direction).

The judging means executes the first comparison to detect the leading edge and the trailing edge of the sheets, and the second comparison at the different timing and under the different conditions to judge whether the sheets are double fed. Accordingly, the detection of the leading edge of the sheet, and the detection of the double feed of the sheets are performed under the different conditions and different timings. Therefore, both the detection of the leading edge of the sheet and the detection of the double feed of the sheets conventionally performed by a plurality of sensors become possible using only a single sensor.

The invention is applicable to an ADF for transporting original sheets to an image reading position, and any general sheet handling apparatus such as a copier kicking out a single sheet from a paper stacker and feeding the sheet to a printing unit.

The disclosures of Japanese Patent Application No. 2003-275916 and No. 2003-275917 both filed on Jul. 17, 2003 are incorporated in the application.

While the invention has been explained with reference to the specific embodiments of the invention, the explanation is illustrative and the invention is limited only by the appended claims.

What is claimed is:

1. A sheet handling apparatus comprising:

a sheet stacker for stacking sheets, separating means for separating and feeding the sheets stacked on the sheet stacker, a register roller disposed adjacent to the separating means, said register roller forming a loop to the sheet transferred from the separating means for correcting a skew of the sheet, an ultrasonic wave sensor composed of a wave sending sensor and a wave receiving sensor and arranged between the separating means and the register roller obliquely relative to a sheet transfer surface therebetween, judging means electrically connected to the wave receiving sensor and having means for taking an output signal from the wave receiving sensor for a predetermined time beginning from a time that the loop of the sheet is removed since the register roller starts rotating from a stopping condition thereof until a trailing edge of the sheet moves away from nipping of the separating means, said judging means detecting a double feed of the sheet based on the output signal for said predetermined time, and control means electrically connected to the judging means and the register roller for controlling the register roller to stop and rotate.

2. A sheet handling apparatus according to claim 1, wherein said waver receiving sensor is arranged above the sheet transfer surface between the separating means and the register roller, and said wave sending sensor is arranged below the sheet transfer surface.

3. A sheet handling apparatus according to claim 1, wherein said judging means continuously detects if the double feed is being made until the trailing edge of the sheet passes through the register roller.

4. A sheet handling apparatus according to claim 1, wherein said separating means stops feeding the sheet from the sheet stacker when the judging means detects the double feed.

5. An image reading apparatus comprising the sheet handling apparatus according to claim 1, transport means for transporting the sheet from the register roller to a reading position, and optical reading means for reading the sheet at the reading position.

6. An image reading apparatus according to claim 5, wherein said optical reading means stops reading the sheet when the judging means detects the double feed.

7. An image reading apparatus according to claim 5, further comprising display means for displaying a sign of the double feed when the judging means detects the double feed after all the sheets stacked on the sheet stacker are read.

* * * * *